US009886007B2

(12) United States Patent
Honda

(10) Patent No.: US 9,886,007 B2
(45) Date of Patent: Feb. 6, 2018

(54) ELECTRONIC TIMEPIECE, ELECTRONIC DEVICE, UPDATE INFORMATION TRANSMISSION DEVICE, AND UPDATE INFORMATION TRANSMISSION PROGRAM

(71) Applicant: Seiko Epson Corporation, Tokyo (JP)

(72) Inventor: Katsuyuki Honda, Miyata (JP)

(73) Assignee: Seiko Epson Corporation (JP)

( * ) Notice: Subject to any disclaimer, the term of this patent is extended or adjusted under 35 U.S.C. 154(b) by 21 days.

(21) Appl. No.: 14/958,064

(22) Filed: Dec. 3, 2015

(65) Prior Publication Data

US 2016/0223994 A1 Aug. 4, 2016

(30) Foreign Application Priority Data

Jan. 30, 2015 (JP) ..... 2015-017215

(51) Int. Cl.
*G04R 20/02* (2013.01)
*G04R 20/06* (2013.01)

(52) U.S. Cl.
CPC ..... *G04R 20/02* (2013.01); *G04R 20/06* (2013.01)

(58) Field of Classification Search
CPC ..... G04R 20/00; G04R 20/02
See application file for complete search history.

(56) References Cited

U.S. PATENT DOCUMENTS 6,215,442 B1 * 4/2001 Sheynblat ..... G01S 5/0009 342/357.25
6,393,263 B1 5/2002 Hayashi
7,821,875 B2 * 10/2010 Punkka ..... G04G 9/0076 368/21
8,077,550 B2 * 12/2011 Akiyama ..... G04R 20/06 368/21
8,385,156 B2 * 2/2013 Ozawa ..... G04R 20/12 368/21
8,879,364 B2 11/2014 Honda
(Continued)

FOREIGN PATENT DOCUMENTS

JP 11-234758 A 8/1999
JP 2011-237314 A 11/2011
JP 2013-181857 A 9/2013

*Primary Examiner* — Amy Cohen Johnson
*Assistant Examiner* — Jason Collins
(74) *Attorney, Agent, or Firm* — Harness, Dickey & Pierce, P.L.C.

(57) ABSTRACT

An electronic device has a GPS receiver that receives satellite signals transmitted from positioning information satellites and computes positioning information; a first storage unit that stores the positioning information and local time information including local time computing information related to the time in the region identified by the positioning information; an update information receiving unit that receives update information for the local time information from an update information transmission device; a second storage unit that stores the update information; a local time computing information acquisition unit that acquires the local time computing information from the first storage unit when the local time computing information corresponding to the positioning information is stored only in the first storage unit, and acquires the local time computing information from the second storage unit when the local time computing information is stored in the second storage unit.

10 Claims, 20 Drawing Sheets

(56) References Cited

U.S. PATENT DOCUMENTS

| | | | | |
|---|---|---|---|---|
| 2007/0159927 | A1* | 7/2007 | Brush | G04G 11/00 368/29 |
| 2007/0206442 | A1 | 9/2007 | Kim | |
| 2011/0280108 | A1* | 11/2011 | Honda | G04R 20/06 368/21 |

* cited by examiner

LOCAL TIME INFORMATION

832

831 8321 8322 8323 8324 8325 8326

| REGION | TIME ZONE INFORMATION | TIME ZONE CHANGE INFORMATION | DST OFFSET INFORMATION | DST START INFORMATION | DST END INFORMATION | DST CHANGE INFORMATION |
|---|---|---|---|---|---|---|
| REGION 1 | UTC+9 | – | 0 | – | – | – |
| REGION 2 | UTC+8 | 2014.10.26 2:00 UTC+9 | 0 | – | – | – |
| REGION 3 | UTC+7 | – | +1 | 01:00 LAST SUNDAY IN MARCH | 02:00 LAST SUNDAY IN OCTOBER | NO DST FROM 2015 |
| REGION 4 | UTC+4 | – | 0 | – | – | – |
| ... | ... | ... | ... | ... | ... | ... |

83

FIG. 5

UPDATE INFORMATION

852

| 851 | 8521 | 8522 | 8523 | 8524 | 8525 | 8526 |
|---|---|---|---|---|---|---|
| REGION INFORMATION | TIME ZONE INFORMATION | TIME ZONE CHANGE INFORMATION | DST OFFSET INFORMATION | DST START INFORMATION | DST END INFORMATION | DST CHANGE INFORMATION |
| REGION 4 | UTC+3 | -- | 0 | -- | -- | -- |

85

FIG. 7

ELECTRONIC TIMEPIECE, ELECTRONIC DEVICE, UPDATE INFORMATION TRANSMISSION DEVICE, AND UPDATE INFORMATION TRANSMISSION PROGRAM

BACKGROUND

1. Technical Field

The present invention relates to an electronic timepiece, an electronic device, an update information transmission device, and an update information transmission program.

2. Related Art

Electronic timepieces that store positioning information, time zone information indicating the time difference to UTC (Coordinated Universal Time) at the location identified by the positioning information, and information related to daylight saving time (DST) in a storage unit, and use this time zone information and DST information (referred to below as local time computing information) to calculate the time corresponding to the positioning information, are known from the literature. See, for example, JP-A-2011-237314.

When the electronic timepiece disclosed in JP-A-2011-237314 corrects and displays the time based on the local time computing information obtained based on the acquired positioning information, and the user then manually adjusts the time, the corrected local time computing information is stored as second adjustment data. When positioning information is next acquired and second adjustment data corresponding to that positioning information is stored in memory, the time is corrected and displayed using the second adjustment data.

However, because the user must manually adjust the local time computing information with the electronic timepiece described in JP-A-2011-237314, adjusting the time is complicated.

The local time computing information also cannot be adjusted for locations other than where the user manually adjusted the time with the electronic timepiece in JP-A-2011-237314.

As a result, when local time computing information (time zone or DST setting) is changed by a country or regional government, for example, and differs from the local time computing information stored in the electronic timepiece, when the user goes to that country or region and acquires the positioning information, the time will be corrected using the old local time computing information, the correct time will not be displayed, and user convenience drops.

SUMMARY

An objective of the present invention is to provide an electronic timepiece, an electronic device, an update information transmission device, and an update information transmission program that can easily update the local time computing information and improve user convenience.

An electronic timepiece according to the invention includes: a time display unit that displays the time; a satellite signal receiver unit that receives satellite signals transmitted from positioning information satellites; a positioning information computing unit that computes positioning information based on the satellite signals received by the satellite signal receiver unit; a first storage unit that stores the positioning information and local time information including local time computing information related to the time in the region identified by the positioning information; an update information receiving unit that receives the update information from an update information transmission device that transmits update information, which is updated local time information; a second storage unit that stores the update information received by the update information receiving unit; a local time computing information acquisition unit that acquires the local time computing information from the first storage unit when the local time computing information corresponding to the positioning information calculated by the positioning information computing unit is stored only in the first storage unit, and acquires the local time computing information from the second storage unit when the local time computing information is stored in the second storage unit; and a time correction unit that corrects the time displayed by the time display unit based on the local time computing information.

This aspect of the invention has a first storage unit that stores local time information and a separate second storage unit that stores update information (updated local time information). The update information is sent from an update information transmission device, received by the update information receiving unit, and stored in the second storage unit. The positioning information computing unit computes and acquires positioning information based on the satellite signals received from positioning information satellites. The local time computing information acquisition unit acquires the local time computing information from the first storage unit when local time computing information corresponding to the positioning information is stored only in the first storage unit, and acquires the local time computing information from the second storage unit when the local time computing information is stored in the second storage unit.

Thus comprised, even when local time computing information for a particular country or region is updated, the local time computing information can be easily updated by receiving update information for the local time computing information from the update information transmission device. There is therefore no need to manually adjust the local time computing information with the electronic timepiece according to the invention, the local time computing information can be easily updated, and user convenience can be improved.

Because the capacity of a battery used in a small electronic timepiece such as a wristwatch is small, the writing process may take a long time because of the large amount of data if all data in the local time information stored in the first storage unit is overwritten with new local time information containing updated local time computing information, and power consumption increases accordingly. This shortens the duration time of the electronic timepiece, and may result in a system shutdown due to the voltage drop.

If only part of the local time information stored in the first storage unit is updated, managing where the local time information for each country or region is stored in the first storage unit becomes complex. Such sophisticated management of the storage unit therefore becomes very difficult with the processing power and programs incorporated in a small electronic timepiece.

The invention, however, receives and stores the updated part of the local time computing information as update information in a second storage unit. The amount of data to be written is therefore small compared with overwriting all data, and the processor load and power consumption can be reduced. The local time computing information can therefore be updated while increasing the duration time of the electronic timepiece, reducing the chance of a system shutdown due to a voltage drop, and operating the electronic timepiece stably.

Furthermore, because the update information is stored in a second storage unit separately from the first storage unit, storage unit management can be handled with a small program and easily achieved in a small electronic timepiece.

In an electronic timepiece according to another aspect of the invention, the local time computing information acquisition unit references the second storage unit; acquires the local time computing information corresponding to the positioning information based on the update information if the local time computing information corresponding to the positioning information is included in the update information stored in the second storage unit; and if the local time computing information corresponding to the positioning information is not included in the update information stored in the second storage unit, references the first storage unit and acquires local time computing information corresponding to the positioning information based on the local time information stored in the first storage unit.

Thus comprised, the local time computing information acquisition unit first references the second storage unit, and acquires the local time computing information from the update information if local time computing information corresponding to the acquired positioning information is contained in the update information.

However, if local time computing information corresponding to the acquired positioning information is not contained in the update information stored in the second storage unit (such as when update information is not stored, or the local time computing information corresponding to the positioning information has not been updated), the local time computing information acquisition unit acquires the local time computing information from the local time information stored in the first storage unit.

The local time computing information contained in the update information is information that is newer than the local time computing information contained in the local time information. As a result, by referencing the update information stored in the second storage unit before referencing the local time information stored in the first storage unit, the step of referencing the first storage unit can be omitted when local time computing information corresponding to the positioning information is contained in the update information. The processing load of the electronic timepiece can therefore be reduced.

Further preferably in an electronic timepiece according to another aspect of the invention, the update information is difference data expressing the difference with the local time information stored in the first storage unit.

The update information may be difference data expressing the difference to the default value of the local time information instead of difference data for the local time information actually stored in the first storage unit. For example, if there are three versions of local time information, Ver. 1 to Ver. 3, the update information may be expressed as the difference between Ver. 3 and Ver. 1 even if Ver. 2 of the local time information is stored in the first storage unit. In this case, however, Ver. 2 of the update information will be stored in both the first storage unit and second storage unit, and the amount of update information stored increases.

By using difference data for the local time information stored in the first storage unit as the update information, this aspect of the invention can minimize the amount of update information stored for the local time information, and can suppress increasing the amount of update information that is stored. For example, when Ver. 2 of the local time information is stored in the first storage unit, the update information is the difference between Ver. 3 and Ver. 2, and the amount of difference data can also be minimized. The processor load and power consumption incurred in the update information reception process and in the process that writes the received update information to the second storage unit can be suppressed.

In an electronic timepiece according to another aspect of the invention, first version information indicating the version of the local time information stored in the first storage unit is stored in the first storage unit; and a first transmission unit reads and sends the first version information from the first storage unit to the update information transmission device.

In this aspect of the invention, the first storage unit stores local time information and first version information indicating the type (version) of this local time information. The first transmission unit reads and sends the first version information to the update information transmission device. As a result, the version of local time information stored in the first storage unit can be easily reported to the update information transmission device. Therefore, the electronic timepiece and update information transmission device can check a part of the local time information stored in the first storage unit, such as the time zone for country A, does not need to confirm the content of the local time information stored in the first storage unit, and by the simple process of reading and transmitting version information can acquire update information appropriate to the version of local time information from the update information transmission device.

In an electronic timepiece according to another aspect of the invention, second version information indicating the version of the update information stored in the second storage unit is stored in the second storage unit; and a second transmission unit reads and sends the second version information from the second storage unit to the update information transmission device.

In this aspect of the invention, the second storage unit stores update information and second version information indicating the type (version) of the update information. The second transmission unit reads and sends the second version information to the update information transmission device. As a result, the version of update information stored in the second storage unit can be easily reported to the update information transmission device.

By referencing the second version information sent from the electronic timepiece, the update information transmission device can determine whether or not the update information stored in the second storage unit is the most recent update information, and can easily decide if sending update information is necessary. Increasing power consumption and the processor load of the electronic timepiece as a result of sending the most recent update information from the update information transmission device to the electronic timepiece even though the most recent update information is already stored in the second storage unit can be suppressed.

An electronic timepiece according to another aspect of the invention preferably also has: a storage battery; a reserve power detection unit that detects the reserve power of the storage battery; and a first writing unit that overwrites data corresponding to the update information in the local time information stored in the first storage unit with the update information stored in the second storage unit if the reserve power detected by the reserve power detection unit is greater than or equal to a first threshold.

The first threshold value is set to a value at which the capacity of the storage battery can be maintained at a level enabling stably driving the electronic timepiece when the process of overwriting local time information stored in the first storage unit based on the update information stored in the second storage unit runs.

This aspect of the invention executes the writing process when the battery capacity is greater than or equal to the first threshold, and does not execute the writing process when the battery capacity is less than the first threshold value. The writing process can therefore be executed without resulting in such problems as the electronic timepiece shutting down.

An electronic timepiece according to another aspect of the invention preferably also has: a generating unit; a storage battery that stores electrical energy produced by the generating unit; a power detection unit that detects the output power of the generating unit; and a second writing unit that overwrites data corresponding to the update information in the local time information stored in the first storage unit with the update information stored in the second storage unit if the power output detected by the power detection unit is greater than or equal to a second threshold.

The second threshold value is set to a value at which power generation sufficient to keep the capacity of the storage battery at a level enabling stably driving the electronic timepiece can be assured when the process of overwriting local time information stored in the first storage unit based on the update information stored in the second storage unit runs.

This aspect of the invention executes the writing process when the output capacity of the generating unit is greater than or equal to the second threshold, and does not execute the writing process when the output capacity is less than the second threshold value. The writing process can therefore be executed without resulting in such problems as the electronic timepiece shutting down.

An electronic timepiece according to another aspect of the invention preferably also has a communication unit that communicates wirelessly with the update information transmission device, and the update information receiving unit acquires the update information transmitted from the update information transmission device through the communication unit.

The update information receiving unit in this aspect of the invention receives update information from the update information transmission device by wireless communication. Update information can therefore be sent to the electronic timepiece more easily than in a configuration in which the electronic timepiece and update information transmission device communicate using a cable or dedicated connection terminal.

Another aspect of the invention is an electronic device including: a time display unit that displays the time; a satellite signal receiver unit that receives satellite signals transmitted from positioning information satellites; a positioning information computing unit that computes positioning information based on the satellite signals received by the satellite signal receiver unit; a first storage unit that stores the positioning information and local time information including local time computing information related to the time in the region identified by the positioning information; an update information receiving unit that receives the update information from an update information transmission device that transmits update information, which is updated local time information; a second storage unit that stores the update information received by the update information receiving unit; a local time computing information acquisition unit that acquires the local time computing information from the first storage unit when the local time computing information corresponding to the positioning information calculated by the positioning information computing unit is stored only in the first storage unit, and acquires the local time computing information from the second storage unit when the local time computing information is stored in the second storage unit; and a time correction unit that corrects the time displayed by the time display unit based on the local time computing information.

This aspect of the invention has the same effect as the electronic timepiece described above.

Another aspect of the invention is an update information transmission device that sends update information to the electronic timepiece according to the invention, the update information transmission device including: a version acquisition unit that acquires first version information indicating the version of the local time information stored in the first storage unit from the electronic timepiece; a data acquisition unit that, based on the first version information acquired by the version acquisition unit, acquires update information from an update information database storing update information; and a transmission process unit that transmits the update information acquired by the data acquisition unit to the electronic timepiece.

The update information database may be managed on the update information transmission device, or on a server with which the update information transmission device can communicate.

Thus comprised, the update information transmission device can send update information acquired from the update information database tot eh electronic timepiece based on the first version information sent from the electronic timepiece. As a result, the update information transmission device can send the appropriate update information to the electronic timepiece.

Another aspect of the invention is an update information transmission device that sends update information to the electronic timepiece according to the invention, the update information transmission device including: a version acquisition unit that acquires first version information indicating the version of the local time information stored in the first storage unit, and second version information indicating the version of the update information stored in the second storage unit, from the electronic timepiece; a data acquisition unit that, based on at least one of the first version information and the second version information acquired by the version acquisition unit, acquires update information from an update information database storing update information; and a transmission process unit that transmits the update information acquired by the data acquisition unit to the electronic timepiece, and sends a terminal update process command to the electronic timepiece if transmitting the update information is determined unnecessary based on the second version information acquired by the version acquisition unit.

Thus comprised, the update information transmission device acquires at least one or first version information and second version information sent from the electronic timepiece, and based on at least one version information, acquires and send update information from the update information database to the electronic timepiece. As a result, the update information transmission device can send the appropriate update information to the electronic timepiece.

In addition, if sending update information is determined unnecessary based on the second version information, the update information transmission device sends a terminate update process command to the electronic timepiece, and therefore only sends update information that is required.

Another aspect of the invention is an update information transmission program run by the update information transmission device according to the invention, the update information transmission program causing the update information transmission device to function as: a version acquisition unit that acquires first version information indicating the version of the local time information stored in the first storage unit from the electronic timepiece; a data acquisition unit that, based on the first version information acquired by the version acquisition unit, acquires update information from an update information database storing update information; and a transmission process unit that transmits the update information acquired by the data acquisition unit to the electronic timepiece.

This aspect of the invention has the same operational effect as the update information transmission device.

Another aspect of the invention is an update information transmission program run by the update information transmission device according to the invention, the update information transmission program causing the update information transmission device to function as: a version acquisition unit that acquires first version information indicating the version of the local time information stored in the first storage unit, and second version information indicating the version of the update information stored in the second storage unit, from the electronic timepiece; a data acquisition unit that, based on at least one of the first version information and the second version information acquired by the version acquisition unit, acquires update information from an update information database storing update information; and a transmission process unit that transmits the update information acquired by the data acquisition unit to the electronic timepiece, and sends a terminal update process command to the electronic timepiece if transmitting the update information is determined unnecessary based on the second version information acquired by the version acquisition unit.

This aspect of the invention has the same operational effect as the update information transmission device.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 5 shows an example of the structure of local time information.

FIG. 7 shows an example of the data structure of update information.

DESCRIPTION OF EMBODIMENTS

Preferred embodiments of the present invention are described below with reference to the accompanying figures.

Embodiment 1

Figure 1:
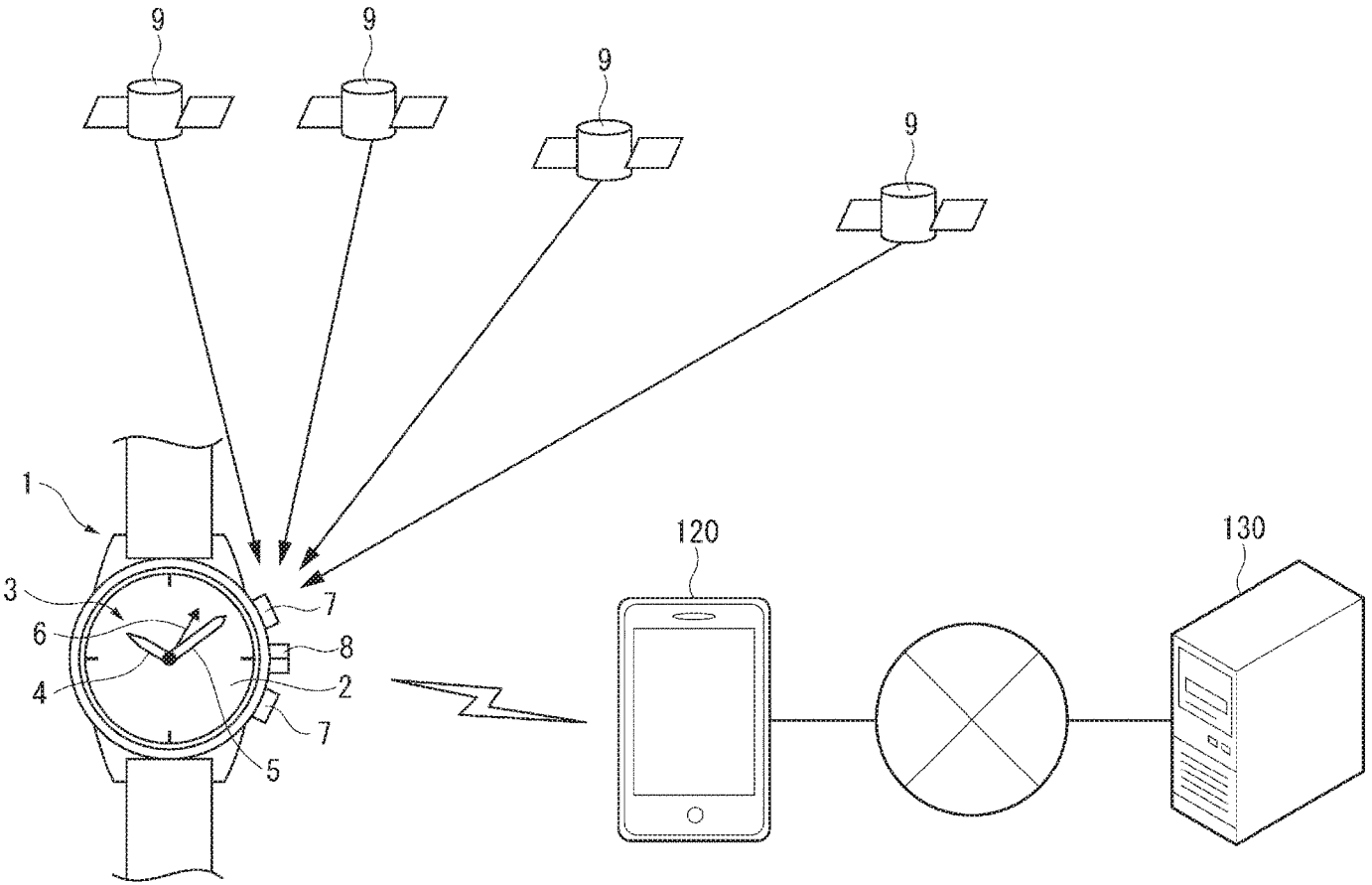
FIG. 1 illustrates an electronic timepiece and electronic device according to a first embodiment of the invention.

FIG. 1 illustrates the use of an electronic timepiece 1, an electronic device 120, and a server 130 according to the invention.

The electronic timepiece 1 is a wristwatch with an internal GPS satellite signal receiver. This electronic timepiece 1 receives satellite signals from at least three GPS satellites 9 orbiting the Earth in space on known orbits, and calculates the location (position) of the electronic timepiece 1. The electronic timepiece 1 also receives satellite signals from at least one GPS satellite 9 to acquire satellite time information and calculate UTC. The electronic timepiece 1 also stores local time information. The local time information is related to the current location (positioning information) and the local time computing information for calculating the time at the current location relative to UTC (the local time).

The electronic timepiece 1 acquires the local time computing information for the current location from the local time information, and using the UTC and local time computing information, adjusts the time displayed by the electronic timepiece 1. The time displayed by the electronic timepiece 1 is therefore the time at the current location.

The electronic timepiece 1 can also communicate with the electronic device 120, which is a mobile device such as a smartphone or tablet computer. When the local time computing information for a particular region is updated in the local time information, the electronic timepiece 1 acquires the update information from the server 130 through the electronic device 120. The update information is local time information comprising positioning information identifying the region for which the local time computing information was updated, and the updated local time computing information. Therefore, the update information is data for a particular region in the local time information, that is, a subset of the local time information that was stored for all regions (time zones) when the electronic timepiece 1 was manufactured.

The electronic timepiece 1 corrects the internal time information based on the local time information and update information. A local time information updating system is thus embodied by the electronic timepiece 1, electronic device 120, and server 130.

The electronic timepiece 1, electronic device 120, and server 130 embodying this updating system are described below in detail.

Electronic Timepiece Configuration

As shown in FIG. 1, the electronic timepiece 1 is an analog timepiece with a dial 2 and hands 3. The hands 3 include an hour hand 4, minute hand 5, and secondhand 6, and are driven by a stepping motor through a wheel train.

The electronic timepiece 1 also has buttons 7 and a crown 8 as input devices (external operating members).

Note that the GPS satellites 9 are used as an example of positioning information satellites in this embodiment of the invention, and there are multiple satellites in orbit. There are currently approximately 30 GPS satellites 9 in service.

Electronic Timepiece Circuits

Figure 2:
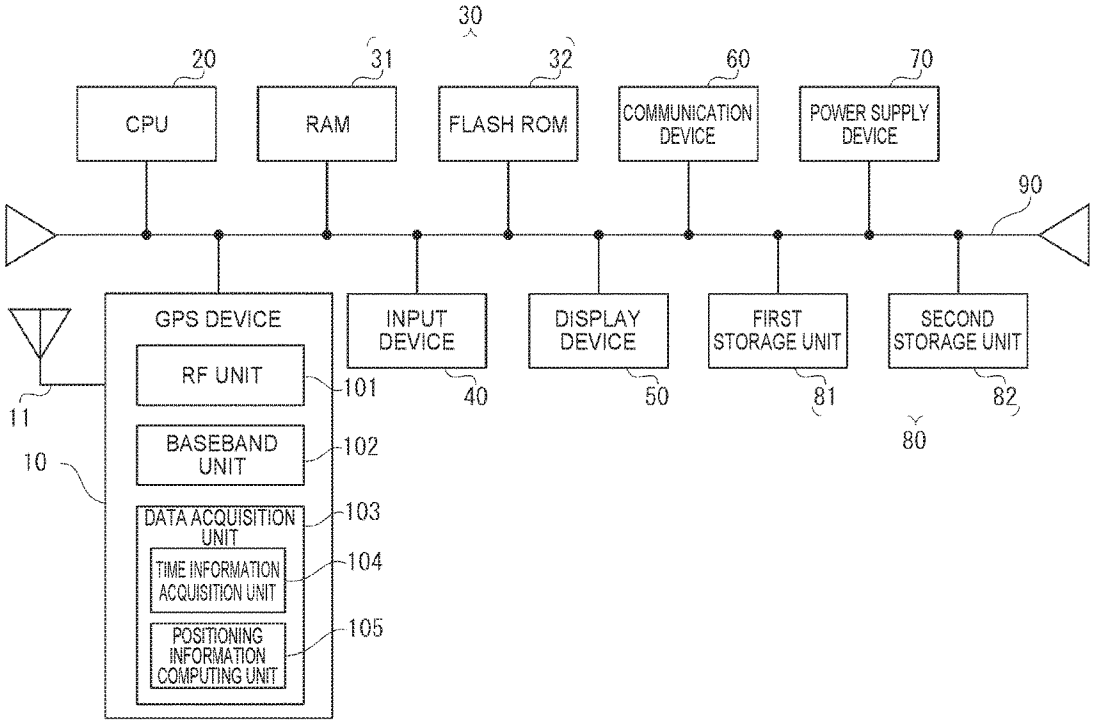
FIG. 2 illustrates the circuit design of the electronic timepiece according to the first embodiment of the invention.

FIG. 2 shows the basic circuit design of the electronic timepiece 1.

As shown in FIG. 2, the electronic timepiece 1 includes a GPS device 10 (GPS module) as an example of the satellite signal receiver, a control device 20 (CPU), a storage device 30, an input device 40, a display device 50 as an example of the time display unit, a communication device 60, a power supply device 70, and a local time information storage device 80. These devices are interconnected by a data bus 90.

GPS Device Configuration

The GPS device 10 includes a GPS antenna 11, processes satellite signals received through the GPS antenna 11, acquires GPS time information, and computes location information.

The GPS antenna 11 receives the satellite signals transmitted from a plurality of GPS satellites 9 orbiting the Earth in space on specific orbits. The GPS antenna 11 may be a ring antenna disposed around the outside circumference of the dial 2, or a patch antenna disposed on the back side of the dial 2, for example.

The GPS device 10 includes an RF (radio frequency) unit 101 that receives and converts satellite signals transmitted from the GPS satellites 9 to digital signals; a baseband unit 102 that executes a reception signal correlation process and demodulates the navigation data message; and a data acquisition unit 103 that acquires time information and positioning information based on the navigation data message (satellite signals) demodulated by the baseband unit 102.

The RF unit 101 includes a bandpass filter, PLL circuit, IF filter, VCO (voltage controlled oscillator), ADC (A/D converter), mixer, LNA (low noise amplifier), and IF amplifier.

The satellite signal extracted by the bandpass filter is amplified by the LNA, mixed by the mixer with the signal from the VCO, and down-converted to an IF (intermediate frequency) signal. The IF signal mixed by the mixer then passes through the IF amplifier and IF filter, and is converted by the A/D converter to a digital signal.

The baseband unit 102 has a local code generator and a correlation unit. The local code generator generates local codes that are the same as the C/A codes used by the GPS satellites 9 for signal transmission. The correlation unit calculates the correlation between the local codes and the reception signal output from the RF unit 101.

If the correlation calculated by the correlation unit equals or exceeds a specific threshold, the C/A code used in the received satellite signal and the local code that was generated match, and the satellite signal can be locked (synchronized). The navigation data message can therefore be demodulated as a result of the correlation process using the received satellite signal and a local code.

The data acquisition unit 103 has a time information acquisition unit 104 that acquires the time information from the navigation data message demodulated by the baseband unit 102, and a positioning information computing unit 105 that computes positioning information from the demodulated navigation data message. More specifically, the navigation data message transmitted from a GPS satellite 9 contains preamble data, the TOW (Time of Week, also called the Z count) of the HOW word, and subframe data. There are five subframes, subframe 1 to subframe 5, and each subframe contains satellite correction data including a week number value and satellite health data, ephemeris data (detailed orbit information for a particular GPS satellite 9), and almanac data (basic orbit information for all GPS satellites 9).

The time information acquisition unit 104 of the data acquisition unit 103 can therefore extract specific data from the received navigation data message to acquire time information, and the positioning information computing unit 105 can likewise compute and acquire positioning information from the navigation data message.

Input device, display device, communication device, and power supply device configurations The input device 40 includes the buttons 7 and crown 8 as an example of external operating members. The input device 40 functions as an operating unit that receives input operations by the user.

The display device 50 includes the dial 2 and hands 3 that are driven by a stepping motor and wheel train to display the time.

The communication device 60 communicates with an external device such as the electronic device 120. The communication device 60 is a wireless communication device compatible with Bluetooth® or Wi-Fi® standards, for example.

The power supply device 70 is capable of supplying power to the electronic timepiece 1. The power supply device 70 may use a primary cell or a storage battery as the power source, and may be rechargeable by a charging means such as a solar panel.

Storage Device Configuration

The storage device 30 includes RAM 31 and flash ROM 32.

Figure 3:
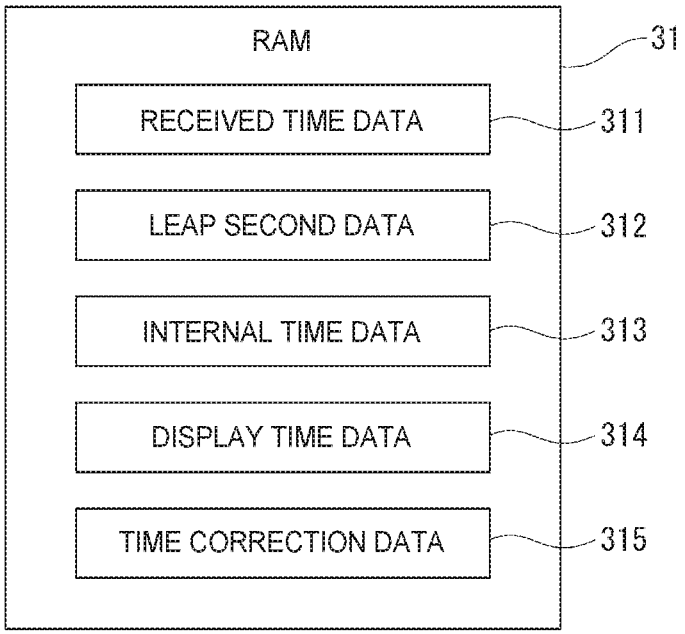
FIG. 3 illustrates the structure of data stored in RAM.

As shown in FIG. 3, storage areas for storing received time data 311, leap second data 312, internal time data 313, time data for display 314, and time correction data 315 are provided in RAM 31.

The received time data 311 stores the time information (satellite time information) acquired from GPS satellite signals. The leap second data 312 stores at least data about the current leap second. More specifically, data related to the leap second, that is, the current leap second value, the week number of the leap second event, the day number of the leap second event, and the future leap second value, is stored on page 18 in subframe 4 of the GPS satellite signal. Of these values, at least the current leap second value is stored in the leap second data 312.

The internal time data 313 stores internal time information. More specifically, when the GPS satellite signal is received and the received time data 311 updated, the internal time data 313 is updated based on the satellite time information stored in the received time data 311 and the current leap second value stored in the leap second data 312. As a result, the internal time data 313 is updated to UTC.

The internal time data 313 is normally updated every second based on a 1-Hz reference signal output from a crystal oscillator not shown, but when a satellite signal is received and the time information acquired, the internal time data 313 is updated based on the acquired time information. The internal time data 313 therefore stores the current UTC.

The time data for display 314 (display time data 314) stores the time obtained by adding the time correction data 315 to the internal time information of the internal time data 313. This time data is data corresponding to the current time (local time) at the current location, that is, the displayed time.

The time correction data 315 indicates the offset of the time at the current location (local time) from UTC, and is acquired based on the local time information described below (see FIG. 5).

Flash ROM 32 stores a program executed by the control device 20, and data used for executing the program. More specifically, flash ROM 32 stores system settings information and reception settings information for driving the electronic timepiece 1. The system setting information defines, for example, the positions of the hands. The reception settings information include, for example, the interval for automatic satellite signal reception, and the timeout period for terminating the reception process when a satellite signal cannot be locked.

Local Time Information Storage Device

The local time information storage device 80 includes a first storage unit 81 and a second storage unit 82. The first storage unit 81 and second storage unit 82 may be embodied using flash ROM, EEPROM, or other type of memory device enabling rewriting data.

First Storage Unit Configuration

Figure 4:
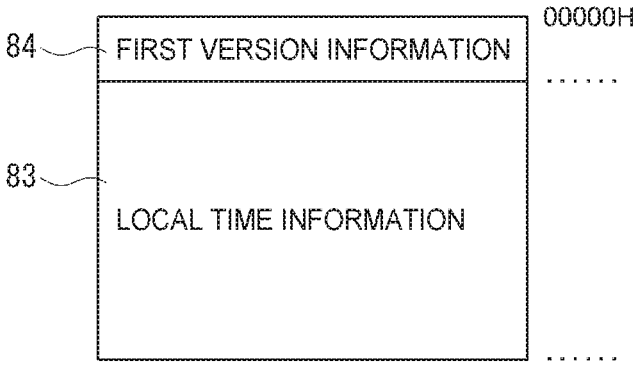
FIG. 4 illustrates the structure of data stored in a first storage unit.

FIG. 4 shows an example of the configuration of data stored in the first storage unit 81. Local time information 83 and first version information 84 indicating the version (edition) of the local time information 83, are stored to specific addresses in the first storage unit 81. The local time information 83 is described in further detail below, but is information relating positioning information to the local time computing information, and by using the local time information 83, the electronic timepiece 1 can acquire the offset between UTC and the current time corresponding to the positioning information as a candidate for the time correction data 315.

Local Time Information

FIG. 5 shows an example of the data structure of the local time information 83.

The local time information 83 relates region information 831 (positioning information) and local time computing information 832.

The local time computing information 832 is information for acquiring the time difference to UTC for the region stored as the region information 831, and includes time zone information 8321, time zone change information 8322, DST offset information 8323, DST start information 8324, DST end information 8325, and DST change information 8326.

The region information 831 is information identifying individual regions defined by dividing geographical information into plural regions. Each region is, for example, a rectangular region that is 1000 to 2000 km long east-west and north-south. Note that the geographical information is map information overlaid with time zones. Coordinate data defining each region is stored as the region information 831. More specifically, if each region is a rectangle, the region can be defined by the coordinates (latitude and longitude) of the top left corner and the coordinates (latitude and longitude) of the bottom right corner, and the coordinates for these two points are stored as the region information 831.

The time zone information 8321 identifies the time zone, or more specifically the time difference to UTC, of each region.

The time zone change information 8322 is information indicating a scheduled change in the time zone, and includes the date and time when the time zone of the particular region changes, and the time difference to UTC after the time zone changes. For example, as shown in FIG. 5, the time difference to UTC in region 2 will change from +8 to +9 hours from 2:00 in the morning of 2014 Oct. 26.

The DST offset information 8323 indicates the offset during DST (daylight saving time) in each region.

The DST start information 8324 indicates when DST starts in each region, and DST end information 8325 indicates when DST ends in each region.

The DST change information 8326 is information indicating a scheduled change in DST, and includes the date and time when the DST setting of a particular region changes, and the offset after the change.

For example, as shown in FIG. 5, the DST offset in region 3 is +1 from the last Sunday in March to the last Sunday in October, and the DST offset starting in 2015 is 0.

Note that if the start and end times for DST are stored as DST rules in flash ROM 32, the local time information 83 may store information specifying the DST rule to apply for each region instead of storing the DST start information 8324 and DST end information 8325.

First Version Information

The first version information 84 identifies the version (edition) of the local time information 83, and is information for determining the content of the local time information 83.

As parameters such as the time zone and DST in the local time computing information change, new local time information is created reflecting the changed information. New first version information 84 is then assigned to the newly created local time information. The first version information 84 is information displaying the version of the local time information by numbers, letters, or symbols, for example.

Because the version of the local time information 83 can be determined by referencing the first version information 84 stored in the first storage unit 81, the electronic device 120 and server 130 can determine if the local time information 83 is the most recent local time information as described below.

Second Storage Unit Configuration

Figure 6:
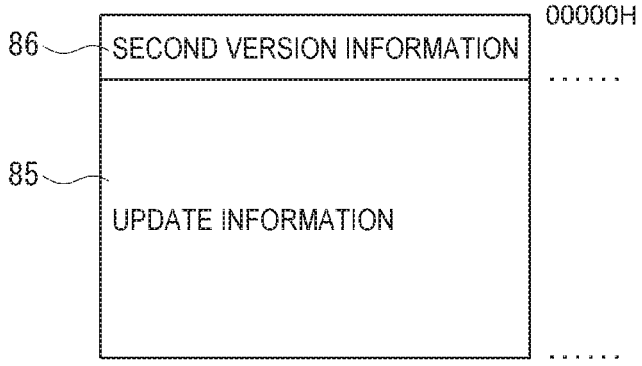
FIG. 6 illustrates the structure of data stored in a second storage unit.

FIG. 6 shows an example of the structure of data stored in the second storage unit 82.

The update information 85 of the local time information 83, and second version information 86 indicating the version of the update information 85, are stored in the second storage unit 82 as described below.

The update information 85 is difference information indicating what part of the local time information 83 stored in the first storage unit 81 was updated.

Update Information Content

FIG. 7 shows an example of the content of the update information 85.

As shown in FIG. 7, the update information 85 is basically the same as the local time information 83 except it comprises information of the updated part, and relates region information 851 (positioning information) to local time computing information 852. Like the local time computing information 832 described above, the local time computing information 852 includes time zone information 8521, time zone change information 8522, DST offset information 8523, DST start information 8524, DST end information 8525, and DST change information 8526.

The update information 85 shown in the example in FIG. 7 contains the local time computing information 852 for region 4 as the information that is different from the local time information 83. In this local time computing information 852, the time zone information 8521 of region 4 has been changed from the time zone information in the local time information 83.

When information in the local time information changes, new local time information is generated. New update information, which is the difference between the new local time information and the local time information 83 stored in the first storage unit 81, is then stored in the update information database 131 described below that is stored on the server 130. This new update information is acquired from the server 130 through the electronic device 120 in the update process described below, and is stored in the update information 85 in the second storage unit 82. In this event, the most recent local time computing information contained in the new local time information can be acquired based on the local time information 83 stored in the first storage unit 81 and the update information 85 stored in the second storage unit 82.

Second Version Information

The second version information 86 indicates the version of the update information 85, and is information for determining the content of the update information 85. In this example, the second version information 86 indicates both the version of the update information 85 and the version of the local time information 83.

Table 1 below shows an example of the corresponding between the first version information 84, second version information 86, and the most recent version of the update information when the most recent local time information is Ver. 3.

Note that the most recent update information is the data difference between the local time information 83 stored in the first storage unit 81 and the most recent local time information.

TABLE 1

| Version information | | |
|---|---|---|
| Local time information stored in first storage unit | Update information stored in second storage unit | Most recent update information |
| Ver.1 | Ver.2.1 (Ver.2-Ver.1) | Ver.3.1 (Ver.3-Ver.1) |
| Ver.1 | none | Ver.3.1 (Ver.3-Ver.1) |
| Ver.1 | none | Ver.3.1 (Ver.3-Ver.2) |

In the example shown in Table 1, each time new local time information is generated, new version information for the local time information is created in the order Ver. 1, Ver. 2, Ver. 3, and so forth. In this example, there two versions of update information for the version of local time information 83 stored in the first storage unit 81.

In the example on the first row in Table 1, the update information 85 stored in the second storage unit 82 is the difference between the local time information of Ver. 2 and the local time information of Ver. 1. More specifically, version information Ver. 2.1 is stored as the second version information 86 in the second storage unit 82. Note that in this case update information Ver. 3.1, which is the difference between local time information Ver. 1 and information Ver. 3, is the most recent update information for the local time information 83 stored in the first storage unit 81.

On the second row in Table 1, local time information 83 Ver. 1 is stored in the first storage unit 81, and when update information 85 is not stored in the second storage unit 82, update information Ver. 3.1, which is the difference between local time information Ver. 3 and local time information Ver. 1, is the most recent update information for the local time information 83.

On the third row in Table 1, local time information 83 Ver. 2 is stored in the first storage unit 81, and when update information 85 is not stored in the second storage unit 82, update information Ver. 3.2, which is the difference between local time information Ver. 3 and local time information Ver. 2, is the most recent update information for the local time information 83.

In this example, the ones digit of the second version information is the number of the most recent version of local time information, and the first decimal is the version of the local time information stored in the first storage unit 81.

As a result, what version of local time information the update information 85 applies to, and whether or not the update information 85 is the most recent update information for the local time information, can be determined by referencing only the second version information.

Control Device Configuration

Figure 8:
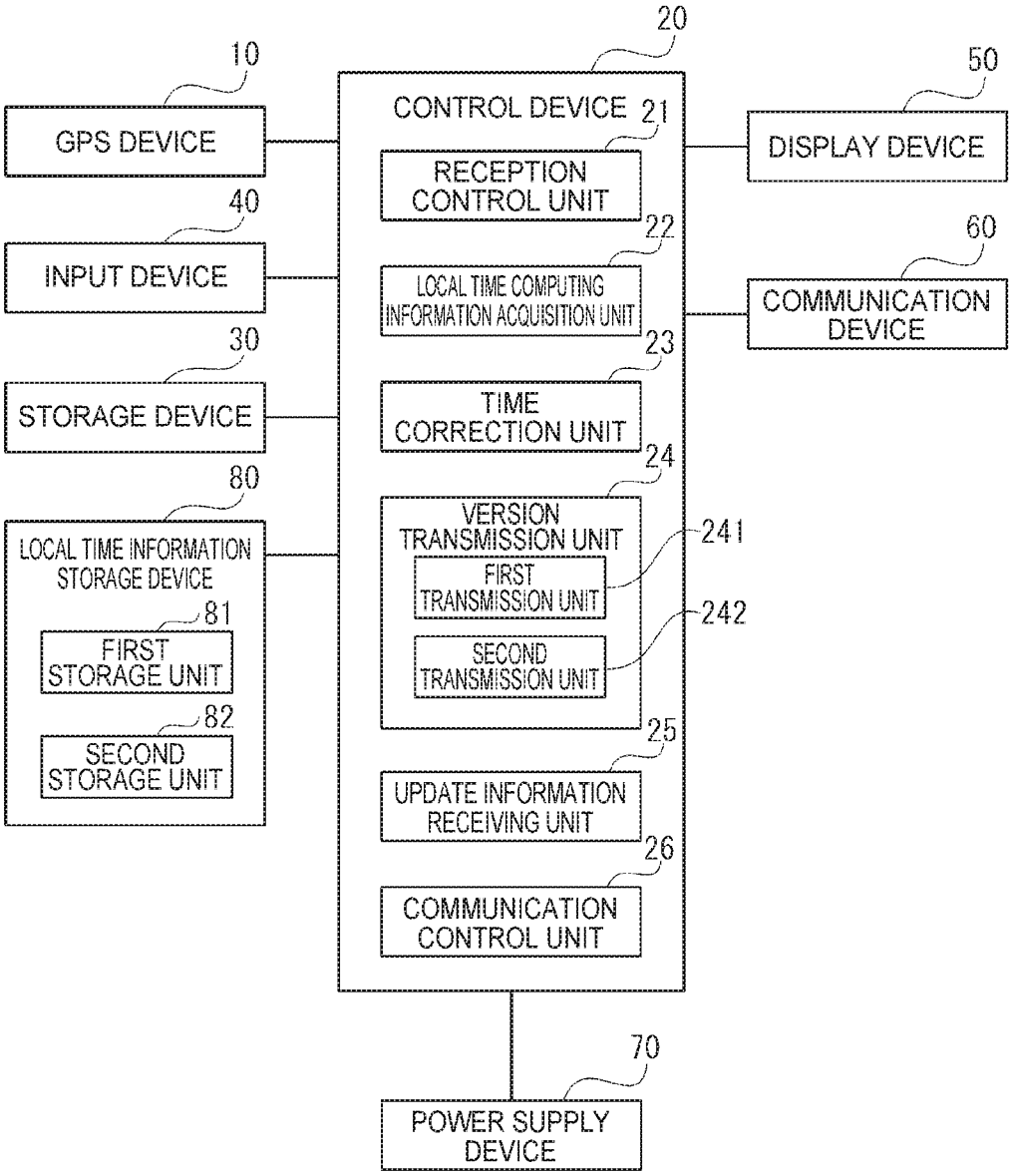
FIG. 8 is a block diagram of the configuration of an electronic timepiece according to the first embodiment of the invention.

FIG. 8 is a block diagram illustrating the configuration of the electronic timepiece 1.

As shown in FIG. 8, the control device 20 includes a reception control unit 21, a local time computing information acquisition unit 22, a time correction unit 23, a version transmission unit 24, an update information receiving unit 25, and a communication control unit 26. The control device 20 (CPU) operates, controls, and keeps time according to a program stored in flash ROM 32. Note that timekeeping is done by counting reference signals output from an oscillation circuit.

When the reception control unit 21 detects based on a signal from the input device 40 that a reception command operation was asserted by a button 7 or other input device 40, it controls driving the GPS device 10 to execute the satellite signal reception process.

The reception control unit 21 then stores the time information acquired by the time information acquisition unit 104 of the GPS device 10 in the received time data 311.

The local time computing information acquisition unit 22 acquires the local time computing information corresponding to the positioning information (latitude and longitude) computed by the positioning information computing unit 105 of the GPS device 10 from the local time information 83 (local time computing information 832) stored in the first storage unit 81, or from the update information 85 (local time computing information 852) stored in the second storage unit 82. The local time computing information acquisition unit 22 stores the acquired local time computing information as the time correction data 315.

More specifically, the local time computing information acquisition unit 22 determines the region corresponding to the positioning information based on the coordinates of the positioning information. The local time computing information acquisition unit 22 then acquires the local time computing information from the update information 85 if the local time computing information corresponding to the identified region is included in the update information 85 in the second storage unit 82, and if it is not included in the update information 85, acquires the local time computing information corresponding to the identified region from the local time information 83 in the first storage unit 81. As a result, the local time computing information acquisition unit 22 acquires the most recent local time computing information corresponding to that region.

The time correction unit 23 updates the internal time data 313 based on the time information (received time data 311) acquired by the GPS device 10 and the leap second data 312, calculates the current time at the current location (local time), which is the displayed time, based on the internal time data 313 and time correction data 315 (local time computing information), and then corrects the display time data 314.

Note that if the internal time data 313 is updated based on the reference signal from the crystal oscillator after the time information is received, the display time data 314 is also updated by adding the time correction data 315 to the internal time data 313. The hands 3 of the display device 50 are then driven based on the display time data 314 to display the time.

The version transmission unit 24 has a first transmission unit 241 and a second transmission unit 242.

The first transmission unit 241 sends the first version information 84 to the communication device 60.

The second transmission unit 242 sends the second version information 86 to the communication device 60 if update information 85 is stored in the second storage unit 82.

The update information receiving unit 25 receives the most recent update information for the local time information 83 stored in the first storage unit 81 from the electronic device 120 through the communication device 60. The update information receiving unit 25 stores the acquired update information and the version information to a specific address in the second storage unit 82.

The communication control unit 26 controls the communication device 60 to communicate with the electronic device 120.

Electronic Device Configuration

Figure 9:
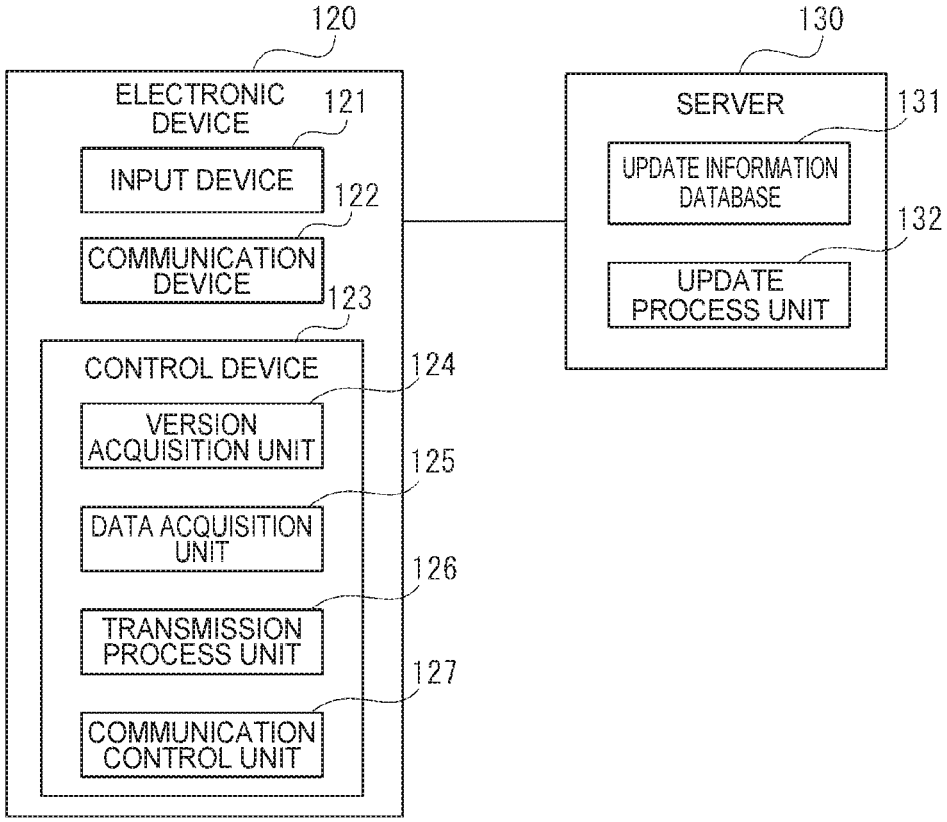
FIG. 9 is a block diagram illustrating the configuration of a server and an electronic device according to the first embodiment of the invention.

FIG. 9 is a block diagram showing the configuration of the electronic device 120 and server 130.

The electronic device 120 functions as a update information transmission device that acquires update information from a server 130 connected to a network and sends the acquired update information to the electronic timepiece 1. This electronic device 120 includes an input device 121, a communication device 122, a control device 123, and a storage device not shown. The storage device stores programs executed by the electronic device 120 (including an update information transmission program), and data that is used when running the programs.

The input device 121 is a device that accepts input operations, and in this example comprises buttons and a touch panel.

The communication device 122 communicates data with the electronic timepiece 1 and the server 130. The communication device 122 is a wireless communication device compatible with Bluetooth® or Wi-Fi® standards, for example.

The control device 123 has a version acquisition unit 124, data acquisition unit 125, transmission process unit 126, and a communication control unit 127.

The version acquisition unit 124 requests the electronic timepiece 1 to transmit version information. In response to the request, the electronic timepiece 1 sends the second version information 86 and first version information 84 to the electronic device 120 if second version information 86 is stored in the second storage unit 82. If second version information 86 is not stored, the electronic timepiece 1 sends the first version information 84 stored in the first storage unit 81. Note that if second version information 86 is stored in the second storage unit 82, the electronic timepiece 1 may send only the second version information 86 to the electronic device 120. This is because the version of local time information stored in the first storage unit 81 can be determined from the second version information 86 alone.

The data acquisition unit 125 sends version information received from the electronic timepiece 1 and an update information request to the server 130. If there is more recent update information for that version information, the data acquisition unit 125 acquires the update information from the server 130. If there is not more recent update information, the data acquisition unit 125 acquires an update unnecessary report saying that a data update is not necessary from the server 130. Note that more recent update information is not found if the local time information 83 stored in the first storage unit 81 is the most recent information, and if the update information 85 stored in the second storage unit 82 is the most recent update information for the local time information 83.

The transmission process unit 126 sends the update information sent from the server 130 to the electronic timepiece 1. If an update unnecessary report is received from the server 130, the transmission process unit 126 sends a terminate update process command to the electronic timepiece 1.

The communication control unit 127 controls communication with the electronic timepiece 1 and the server 130 through the communication device 122.

Server Configuration

The server 130 can communicate with the electronic device 120 over a network, and in response to requests from the electronic device 120, sends the most recent update information for the local time information 83. This server 130 has an update information database 131 and an update process unit 132.

The update information database 131 relationally stores update information for the most recent local time information, and the version information of the update information, for each version of the local time information.

The update process unit 132 sends update information to the electronic device 120 in response to a request from the electronic device 120. This update process unit 132 receives the version information sent from the electronic timepiece 1 from the electronic device 120. If there is more recent update information for this version information, the update process unit 132 acquires and sends the most recent update information from the update information database 131 to the electronic device 120. If there is not more recent update information, the update process unit 132 sends an update unnecessary report to the electronic device 120.

For example, in the example of the first row in Table 1, the update process unit 132 receives Ver. 1 as the first version information 84 and Ver. 2.1 as the second version information 86 from the electronic device 120. In this event, because the most recent local time information is Ver. 3, the update process unit 132 sends update information Ver. 3.1, which is the data representing the difference between Ver. 3 and Ver. 1.

Likewise in the case of the third row in Table 1, the first version information 84 is Ver. 1, and the update process unit 132 therefore sends update information Ver. 3.1, which is the data representing the difference between Ver. 3 and Ver. 1.

In the case of the second row in Table 1, the first version information 84 is Ver. 2, and the update process unit 132 therefore sends update information Ver. 3.2, which is the data representing the difference between Ver. 3 and Ver. 2.

Note that if the second version information 86 is Ver. 3.1 or Ver. 3.2, the update information 85 is the most recent update information for the most recent local time information, and the update process unit 132 therefore sends the update unnecessary report to the electronic device 120.

Update Process on the Electronic Timepiece

Figure 10:
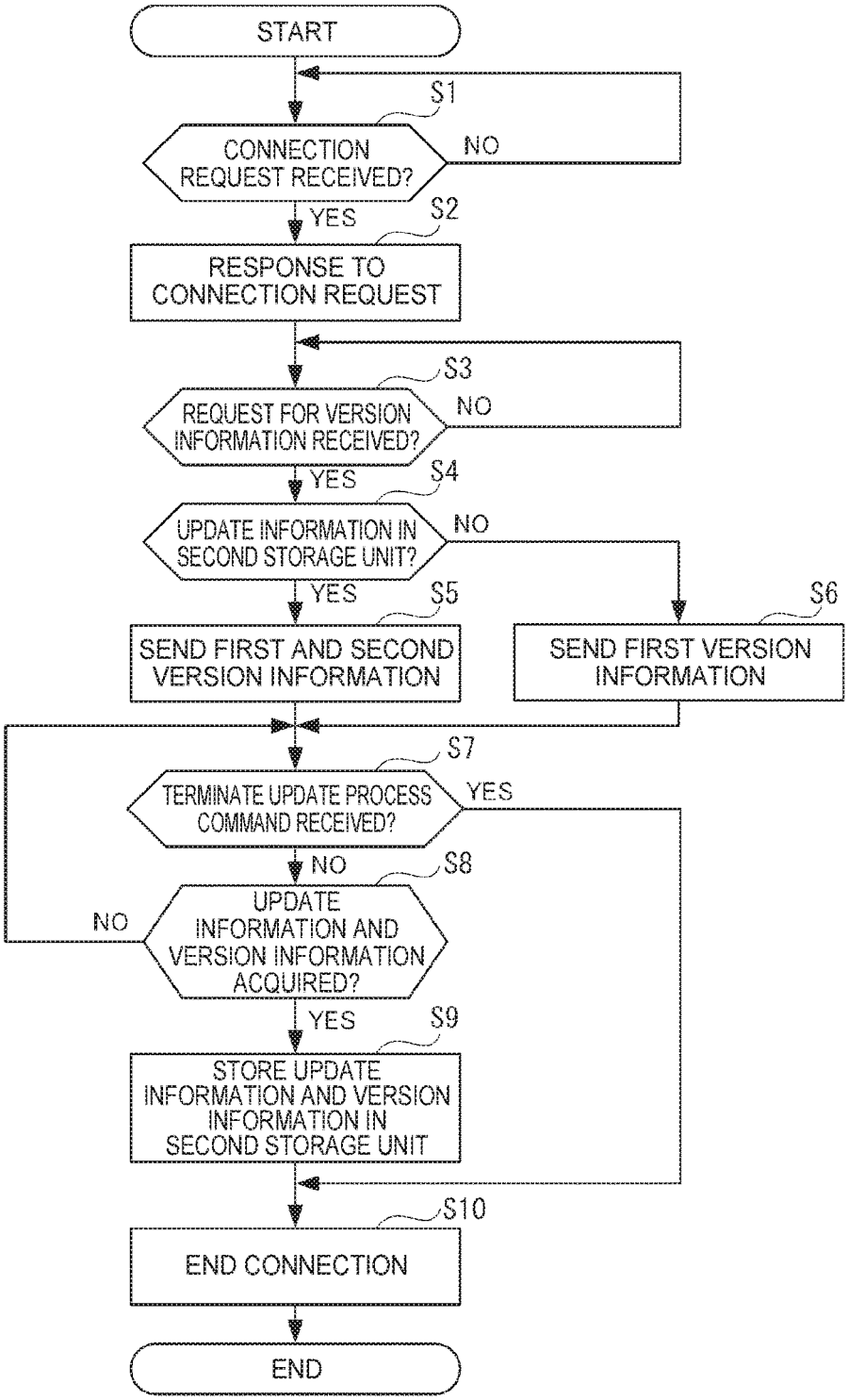
FIG. 10 is a flow chart of the update process of an electronic timepiece according to the first embodiment of the invention.

FIG. 10 is a flow chart showing an example of the update process on the electronic timepiece 1.

As described further below, the electronic device 120 starts the update process in response to a user action, and sends a connect request to the electronic timepiece 1.

On the electronic timepiece 1, as shown in FIG. 10, the communication control unit 26 waits until a connect request is received from the electronic device 120 (step S1: NO). When a connect request is received from the electronic device 120 (step S1: YES), the electronic timepiece 1 opens a connection with the electronic device 120 in response to the request (step S2.

The second transmission unit 242 of the version transmission unit 24 waits until a version information request is received from the electronic device 120 (step S3: NO). When a version information request is received from the electronic device 120 (step S3: YES), the second transmission unit 242 determines if second version information 86 is stored in the second storage unit 82 (step S4).

If update information 85 is stored in the second storage unit 82 (step S4: YES), the second transmission unit 242 of the version transmission unit 24 sends the first version information 84 and second version information 86 stored in the first storage unit 81 and second storage unit 82 to the electronic device 120 (step S5).

If update information 85 is not stored in the second storage unit 82 (step S4: NO), the first transmission unit 241 of the version transmission unit 24 sends the first version information 84 stored in the first storage unit 81 to the electronic device 120 (step S6).

Next, the update information receiving unit 25 determines if a terminate update process command was received from the electronic device 120 (step S7).

In other words, if the update information 85 stored in the second storage unit 82 is the most recent update information, or the local time information 83 stored in the first storage unit 81 is the most recent and there is no update information, the electronic device 120 does not need to acquire new update information. In this event, the electronic device 120 receives a terminate update process command from the server 130.

If a terminate update process command was not received (step S7: NO), the update information receiving unit 25 determines if update information from the electronic device 120 and the version information of this update information were received (step S8). Note that the update information is the most recent update information for the local time information 83, and the version information is information indicating the version of the update information.

If update information and version information have not been received (step S8: NO), the update information receiving unit 25 repeats step S7 and step S8 until a terminate update process command, or update information and version information, is received from the electronic device 120.

If the update information receiving unit 25 determines that update information and version information were acquired (step S8: YES), the update information receiving unit 25 stores the acquired update information and version information in the second storage unit 82 (step S9). More specifically, the update information receiving unit 25 overwrites the update information 85 and second version information 86 stored in the second storage unit 82 with the newly acquired update information and version information.

If the update information receiving unit 25 received a terminate update process command (step S7: YES), and stored new update information 85 and second version information 86 to the second storage unit 82 (step S9), the communication control unit 26 ends the connection with the electronic device 120 and terminates the update process (step S10).

Update Process on the Electronic Device

Figure 11:
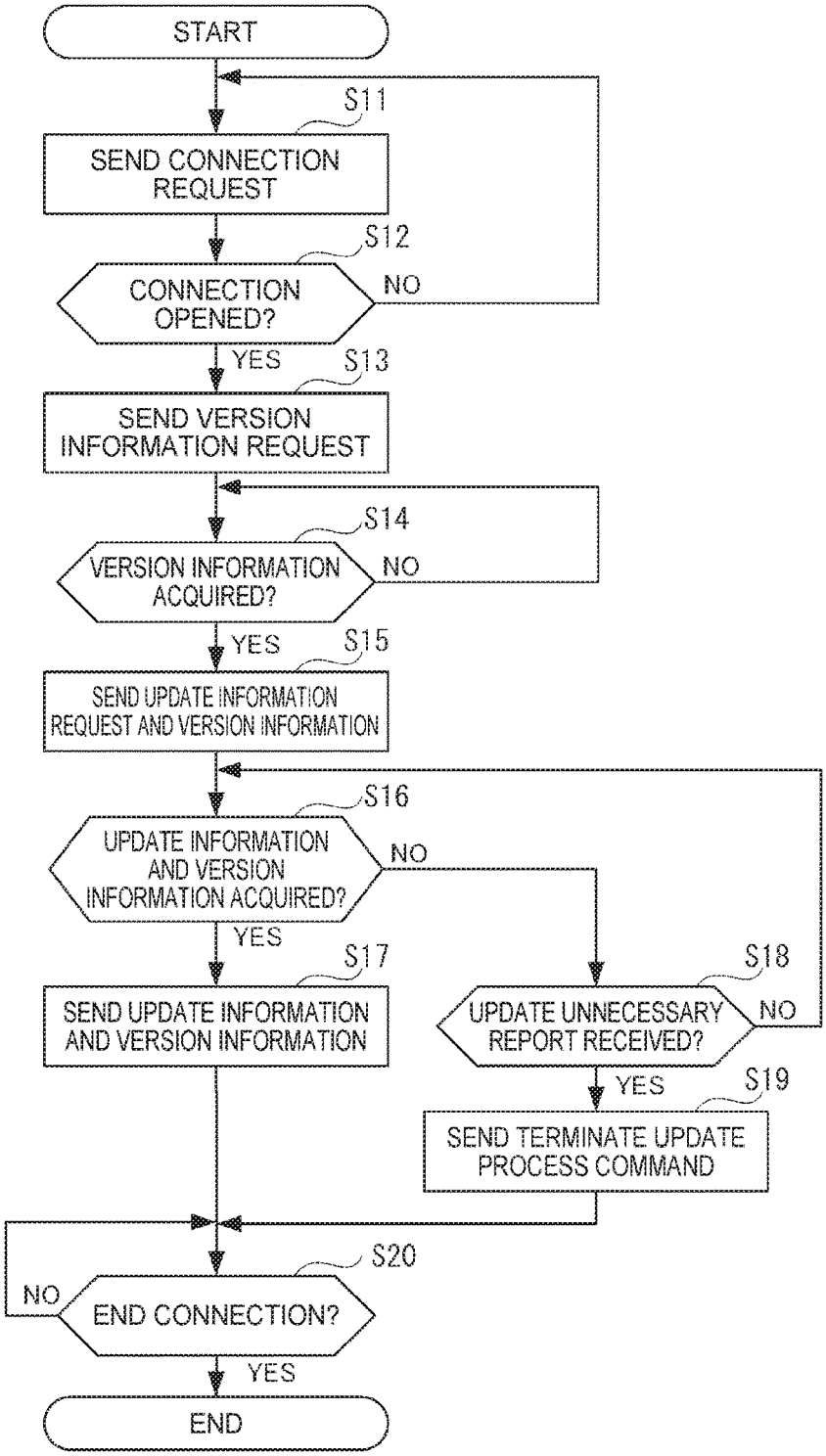
FIG. 11 is a flow chart of the update process of an electronic device according to the first embodiment of the invention.

FIG. 11 is a flow chart of an example of the update process on the electronic device 120.

The electronic device 120 starts the update process in FIG. 11 when the user asserts a command to start the update process through the input device 121.

The communication control unit 127 first sends a connect request to the electronic timepiece 1 (step S11). Next, the communication control unit 127 determines if a connection was opened between the electronic timepiece 1 and the electronic device 120 as a result of the electronic timepiece 1 responding to the connect request (step S12). If a connection between the electronic timepiece 1 and electronic device 120 is not opened (step S12: NO), the communication control unit 127 repeats step S11 and step S12 until a connection is opened. The electronic device 120 ends the update process if a connection is not opened within a specific time.

When a connection is opened between the electronic timepiece 1 and electronic device 120 (step S12: YES), the version acquisition unit 124 sends a version information request to the electronic timepiece 1 (step S13).

The version acquisition unit 124 determines if version information sent from the electronic timepiece 1 was acquired in response to the version information request (step S14).

If version information has not been acquired (step S14: NO), the version acquisition unit 124 repeats. If the version information was acquired (step S14: YES), the data acquisition unit 125 sends the version information sent from the electronic timepiece 1 with an update information request to the server 130 (step S15).

As described further below, when version information is received, the server 130 sends the update information and the version information of the update information, or an update unnecessary report, to the electronic device 120 based on the version information.

Next, the data acquisition unit 125 determines if update information and version information was received from the server 130 (step S16).

If update information and version information was acquired (step S16: YES), the transmission process unit 126 sends the acquired update information and version information to the electronic timepiece 1 (step S17).

If the update information and version information has not been acquired (step S16: NO), the data acquisition unit 125 determines if an update unnecessary report was received from the server 130 (step S18).

If an update unnecessary report was received (step S18: YES), the transmission process unit 126 sends a terminate update process command to the electronic timepiece 1 (step S19).

Note that the data acquisition unit 125 repeats step S16 and step s17 until the update information and version information or an update unnecessary report is received.

After the transmission process unit 126 sends the update information and version information (step S17), or sends a terminate update process command (step S19) to the electronic timepiece 1, the communication control unit 127 determines if the connection to the electronic device 120 ended (step S20). When the connection with the electronic timepiece 1 ends, the update process ends.

Update Process on the Server

Figure 12:
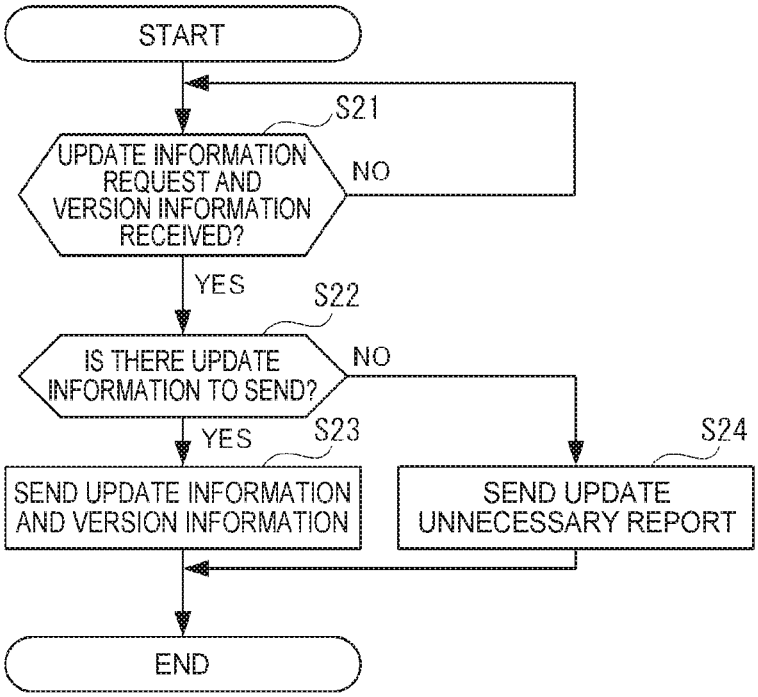
FIG. 12 is a flow chart of the update process of a server according to the first embodiment of the invention.

FIG. 12 is a flow chart showing an example of the update process on the server 130.

The server 130 sends the update information corresponding to the request from the electronic device 120 to the electronic device 120.

The update process unit 132, as shown in FIG. 12, determines if an update information request and version information were received from the electronic device 120 (step S21). The update process unit 132 repeats step S21 until an update information request and version information are received.

If an update information request and version information were received (step S21: YES), the update process unit 132 references the update information database 131, and determines if there is update information to send (step S22). Note that the update process unit 132 determines if there is update information to send based on the received version information as described above.

If there is update information to send (step S22: YES), the update process unit 132 sends the update information and the update information version information to the electronic device 120 (step S23).

If there is no update information to send (step S22: NO), the update process unit 132 sends an update unnecessary report to the electronic device 120 (step S24).

Time Calculation Process

Figure 13:
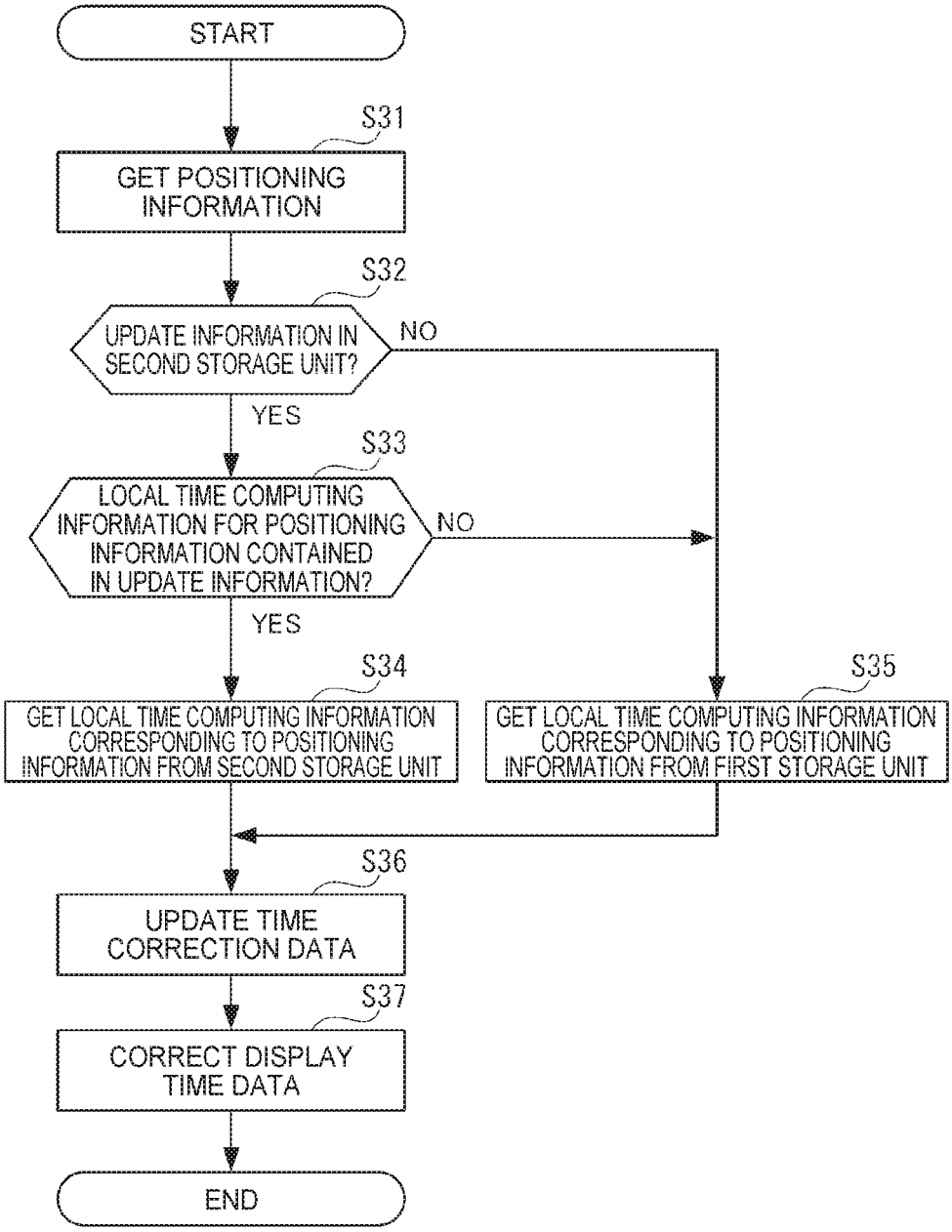
FIG. 13 is a flow chart of the time calculation process of an electronic timepiece according to the first embodiment of the invention.

FIG. 13 is a flow chart showing an example of the time calculation process of the electronic timepiece 1.

The electronic timepiece 1 executes the time calculation process when the user asserts a command to run the time calculation process, and at specific previously set times.

As shown in FIG. 13, the reception control unit 21 of the control device 20 drives the GPS device 10 to calculate and acquire the positioning information (step S31). The satellite time information is also acquired at this time, and based on the satellite time information the received time data 311 is updated and the internal time data 313 is updated using the leap second data 312.

Next, the local time computing information acquisition unit 22 determines if update information 85 is stored in the second storage unit 82 (step S32).

If update information 85 is stored in the second storage unit 82 (step S32: YES), the local time computing information acquisition unit 22 determines if the local time computing information for the positioning information acquired in step S31 is contained in the update information 85 (step S33). More specifically, the local time computing information acquisition unit 22 determines if region information 831 corresponding to the positioning information is contained in the update information 85.

If local time computing information corresponding to the positioning information is contained in the update information 85 (step S33: YES), the local time computing information acquisition unit 22 references the update information 85 in the second storage unit 82 and acquires the local time computing information corresponding to the positioning information (step S34).

If update information 85 is not stored in the second storage unit 82 (step S33: NO), the local time computing information acquisition unit 22 references the local time information 83 in the first storage unit 81 and acquires the local time computing information corresponding to the positioning information acquired in step S31 (step S35).

Next, the local time computing information acquisition unit 22 stores the acquired local time computing information as the time correction data 315 in RAM31 (step S36).

Next, the time correction unit 23 adds the time correction data 315 to the internal time data 313 and adjusts the display time data 314 (step S37). More specifically, the time (display time data 314) at the current location can be calculated by adding the time correction data 315, which is the offset to UTC, to the internal time data 313 that was updated based on the satellite time information. The electronic timepiece 1 then displays the time at the current location on the display device 50 based on the display time data 314.

Effect of Embodiment 1

The effect of this embodiment of the invention is described next.

The electronic timepiece 1 has a first storage unit 81 that stores local time information 83, and a second storage unit 82 that stores update information 85 for the local time information 83. The update information receiving unit 25 in this electronic timepiece 1 stores the update information 85 acquired from an external electronic device 120 in the second storage unit 82. The positioning information computing unit 105 calculates and acquires positioning information based on satellite signals sent from positioning information satellites. The local time computing information acquisition unit 22 references the first storage unit 81 and second storage unit 82, and acquires the most recent local time computing information corresponding to the acquired positioning information. In other words, when local time computing information corresponding to the positioning information is contained in the update information 85 stored in the second storage unit 82, the most recent local time computing information is acquired from the update information 85, and when it is not contained, the most recent local time computing information is acquired from the local time information 83.

As a result, even when the local time information is updated, the correct time can be displayed using local time computing information corresponding to the update.

The electronic timepiece 1 also has a first storage unit 81 that stores the local time information 83, and a second storage unit 82 that stores update information 85. Update information sent from the electronic device 120 is stored in the second storage unit 82. If local time information corresponding to the positioning information is only stored in the first storage unit 81, the local time computing information acquisition unit 22 acquires the local time computing information from the first storage unit 81, and if stored in the second storage unit 82, acquires the local time computing information from the second storage unit 82.

Thus comprised, even when local time computing information for a particular country or region is updated, the local time computing information can be easily updated by receiving update information for the local time computing information from the electronic device 120. There is therefore no need to manually adjust the local time computing information with the electronic timepiece 1 according to this embodiment, the local time computing information can be easily updated, and user convenience can be improved.

When the electronic timepiece 1 runs the rewriting process that overwrites all data in the local time information 83 stored in the first storage unit 81 with new local time information, power consumption by the rewriting process may deplete the power supply to the extent that stable operation of the electronic timepiece cannot be assured. For example, current consumption by the rewriting process is approximately 5 mA when the first storage unit is EEPROM, and current consumption by the rewriting process is approximately 20 mA when the storage unit is flash memory. Current consumption by the process of rewriting the local time information 83 in the first storage unit 81 is thus significantly greater than current consumption during normal operation of the electronic timepiece 1. The power supplied from the power supply device 70 may therefore drop, and stably driving the electronic timepiece 1 may not be possible, as a result of the rewriting process.

However, by storing the update information in the second storage unit 82 and referencing this update information 85, the electronic timepiece 1 can computer the display time corresponding to the updated local time information without overwriting the local time information 83 stored in the first storage unit 81. Because the update information is difference data and the amount of data is small, current consumption is still low when storing the update information to the second storage unit 82. The display time appropriate to the updated local time information can therefore be acquired while continuing to operate the electronic timepiece 1 stably.

The electronic timepiece 1 can also communicate with the electronic device 120, and can acquire and store update information sent from the electronic device 120 in the second storage unit 82 by means of the update information receiving unit 25. As a result, the update information can be easily stored in the second storage unit 82, and the local time information can be easily updated.

The local time computing information acquisition unit 22 first references the second storage unit 82, if local time computing information corresponding to the positioning information is contained in the update information 85 stored in the second storage unit 82 acquires the local time computing information from the update information 85, and if local time computing information is not contained in the update information 85, acquires the local time computing information from the local time information 83 stored in the first storage unit 81.

By thus referencing the update information 85 stored in the second storage unit 82 before referencing the local time information 83 stored in the first storage unit 81, the step of referencing the local time information 83 can be omitted when local time computing information corresponding to the positioning information is contained in the update information 85. The processing load of the electronic timepiece 1 can therefore be reduced.

The version of the local time information 83 can also be reported to the electronic device 120 by the version transmission unit 24 sending the first version information 84 of the local time information 83 to the electronic device 120. The electronic device 120 can therefore acquire the update information appropriate to the version of the local time information 83 from the server 130 and send the update information to the electronic timepiece 1.

The server 130 can also determine whether or not sending the update information 85 is necessary as a result of the version transmission unit 24 sending the second version information 86 through the electronic device 120 to the server 130. Therefore, when the update information 85 is the most recent version, increasing power consumption and the processor load as a result of sending the same update information again can be suppressed.

The electronic timepiece 1 can also communicate wirelessly with the electronic device 120. Therefore, the electronic timepiece 1 can easily send the version information to an external device capable of wireless communication, and can easily acquire update information and version information from such an external device.

Embodiment 2

A second embodiment of the invention is described next with reference to FIG. 14 and FIG. 15.

In the electronic timepiece according to the second embodiment of the invention, the storage unit electronic timepiece 1 that stores the local time information is disposed in the GPS device, and the GPS device acquires the local time computing information based on the positioning information and local time information. The electronic timepiece then calculates the time using whichever of the local time computing information acquired by the GPS device and the local time computing information contained in the update information is newer.

Note that like or similar parts in this and the foregoing embodiment are identified by the same reference numerals, and further description thereof is omitted or simplified.

Figure 14:
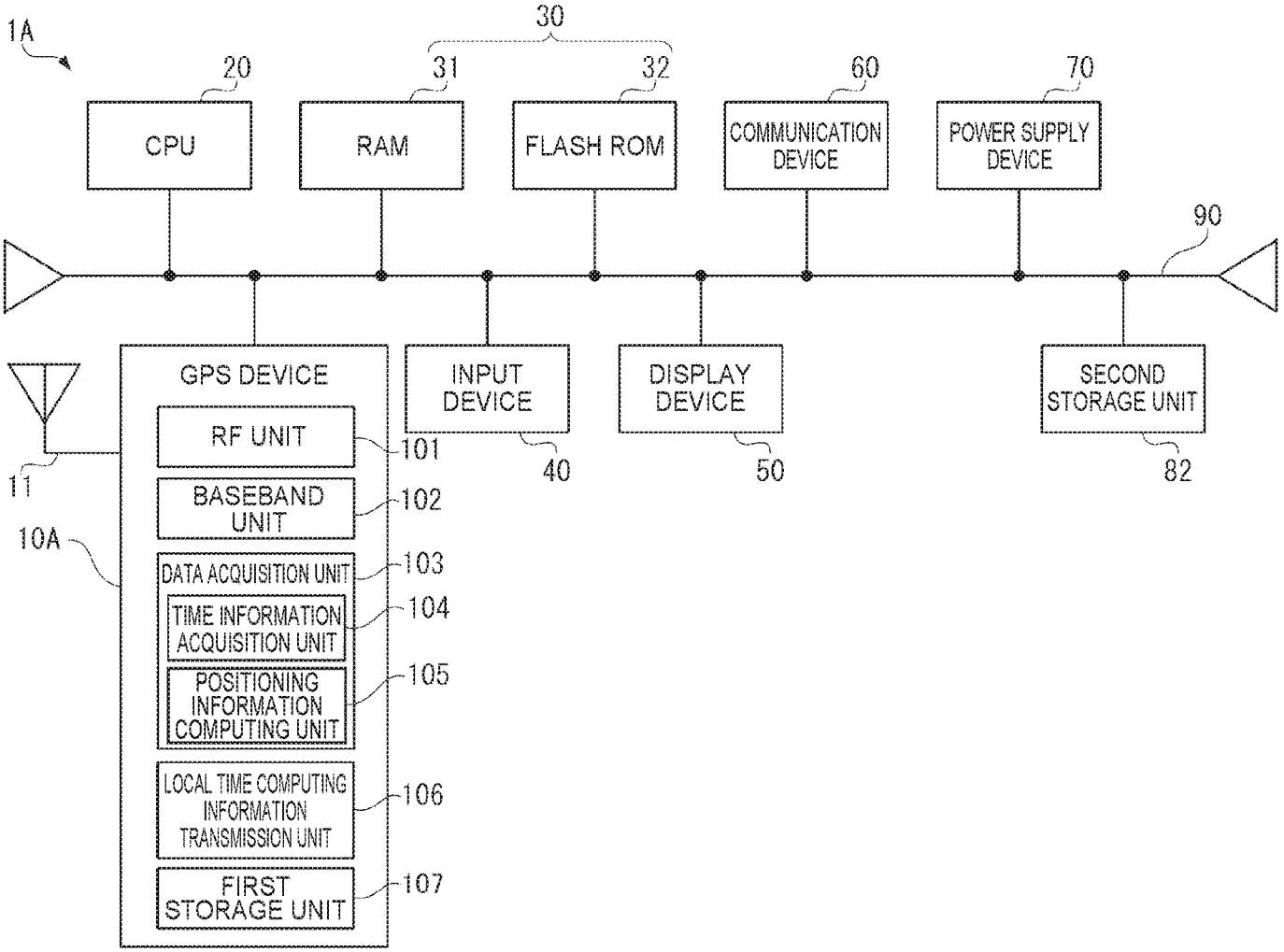
FIG. 14 illustrates the circuit design of the electronic timepiece according to a second embodiment of the invention.

FIG. 14 is a block diagram illustrating the circuit configuration of the electronic timepiece 1A.

As shown in FIG. 14, the GPS device 10A includes the GPS antenna 11, RF unit 101, baseband unit 102, data acquisition unit 103, a local time computing information transmission unit 106, and first storage unit 107.

The local time computing information transmission unit 106 acquires the local time computing information (referred to below as the first local time computing information) corresponding to the positioning information acquired by the positioning information computing unit 105 of the data acquisition unit 103 from the local time information 83 stored in the first storage unit 107, and sends the acquired local time computing information to the control device 20.

Like the first storage unit 81 in the first embodiment, the first storage unit 107 stores the local time information 83 and first version information 84.

Time Calculation Process

Figure 15:
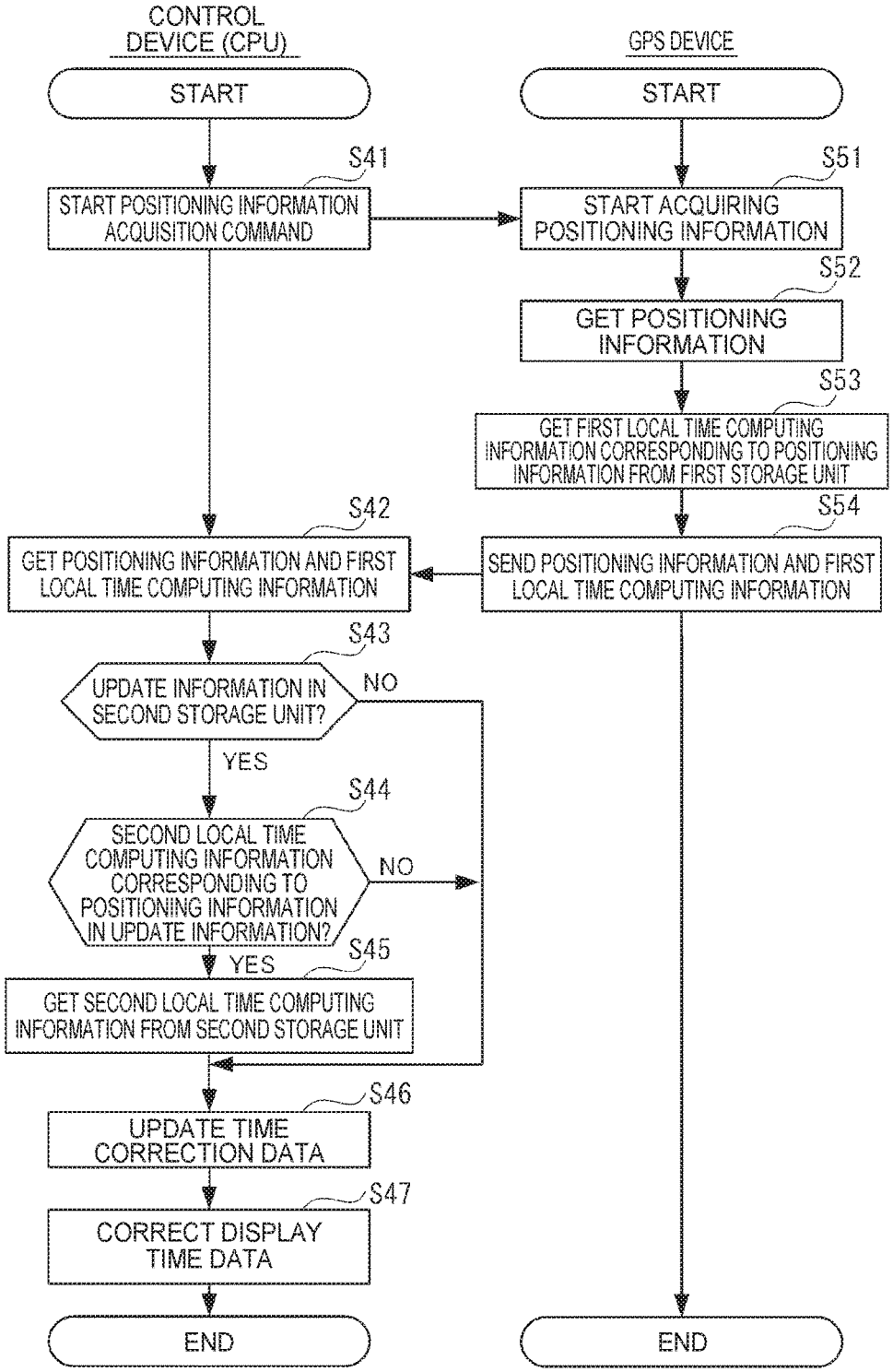
FIG. 15 is a flow chart of the time calculation process of an electronic timepiece according to the second embodiment of the invention.

FIG. 15 is a flow chart showing an example of the time calculation process in the electronic timepiece 1A according to the second embodiment of the invention.

The electronic timepiece 1A executes the time calculation process when the user asserts a command to run the time calculation process, and at specific previously set times.

As shown in FIG. 15, the reception control unit 21 of the control device 20 commands the GPS device 10A to acquire positioning information, and drives the GPS device 10A (step S41).

The GPS device 10A receives the positioning information acquisition command and receives satellite signals.

The positioning information computing unit 105 first starts acquiring positioning information and receives satellite signals (step S51). Next, the positioning information computing unit 105 calculates and acquires the positioning information based on the satellite signals (step S52).

Next, the local time computing information transmission unit 106 acquires the local time computing information corresponding to the acquired positioning information from the local time information 83 in the first storage unit 107 (step S53).

Next, the local time computing information transmission unit 106 sends the positioning information and first local time computing information to the control device 20 (step S54).

Note that as in the first embodiment, satellite time information is acquired based on satellite signals, and the received time data 311 and internal time data 313 are updated based on the acquired satellite time information.

The control device 20 acquires the positioning information and first local time computing information from the GPS device 10A (step S42).

Next, the local time computing information acquisition unit 22 of the control device 20 determines whether or not update information 85 is stored in the second storage unit 82 (step S43).

If update information 85 is stored in the second storage unit 82 (step S43: YES), the local time computing information acquisition unit 22 determines if the local time computing information for the acquired positioning information is contained in the update information 85 (step S44).

If local time computing information corresponding to the positioning information is contained in the update information 85 (step S44: YES), the local time computing information acquisition unit 22 references the update information 85 in the second storage unit 82, acquires the local time computing information (second local time computing information) corresponding to the positioning information (step S45), stores the second local time computing information as the time correction data 315 in RAM 31, and updates the time correction data 315 (step S46).

If the update information 85 is not stored in the second storage unit 82 (step S43: NO) or if local time computing information corresponding to the positioning information is not contained in the update information 85 (step S44: NO), the local time computing information acquisition unit 22 stores the first local time computing information acquired in step S42 in RAM 31 as the time correction data 315, and updates the time correction data 315 (step S46).

Next, the time correction unit 23 adds the time correction data 315 to the internal time data 313, and corrects the display time data 314 (step S47). As a result, the time calculation process that calculates the time at the current location ends.

Effect of Embodiment 2

In addition to the effects of the first embodiment described above, this second embodiment has the following effect.

In the second embodiment, the GPS device 10A acquires first local time computing information corresponding to the positioning information from the local time information 83 stored in the first storage unit 107. The GPS device 10A then outputs the acquired first local time computing information to the control device 20.

As a result, the process of acquiring the first local time computing information from the local time information can be prevented from increasing the processing load of the control device 20.

A GPS device 10A is normally configured to run a process of receiving satellite signals and acquiring positioning information and satellite time information from the received satellite signals. Such a GPS device 10A can also easily execute the process of acquiring the first local time computing information from the local time information. As a result, the GPS device 10A can be controlled to acquire the first local time computing information while controlling driving the control device 20 normally, and processing by the control device 20 can be simplified in addition to reducing the processing load of the control device 20.

Embodiment 3

A third embodiment of the invention is described next with reference to FIG. 16 and FIG. 17.

When the most recent update information for the local time information is stored in the second storage unit, the electronic timepiece according to the third embodiment of the invention executes the rewriting process of overwriting the local time information stored in the first storage unit with the update information if the supply voltage of the power supply device is greater than or equal to a specific threshold.

Note that like or similar parts in this and the foregoing embodiments are identified by the same reference numerals, and further description thereof is omitted or simplified.

Figure 16:
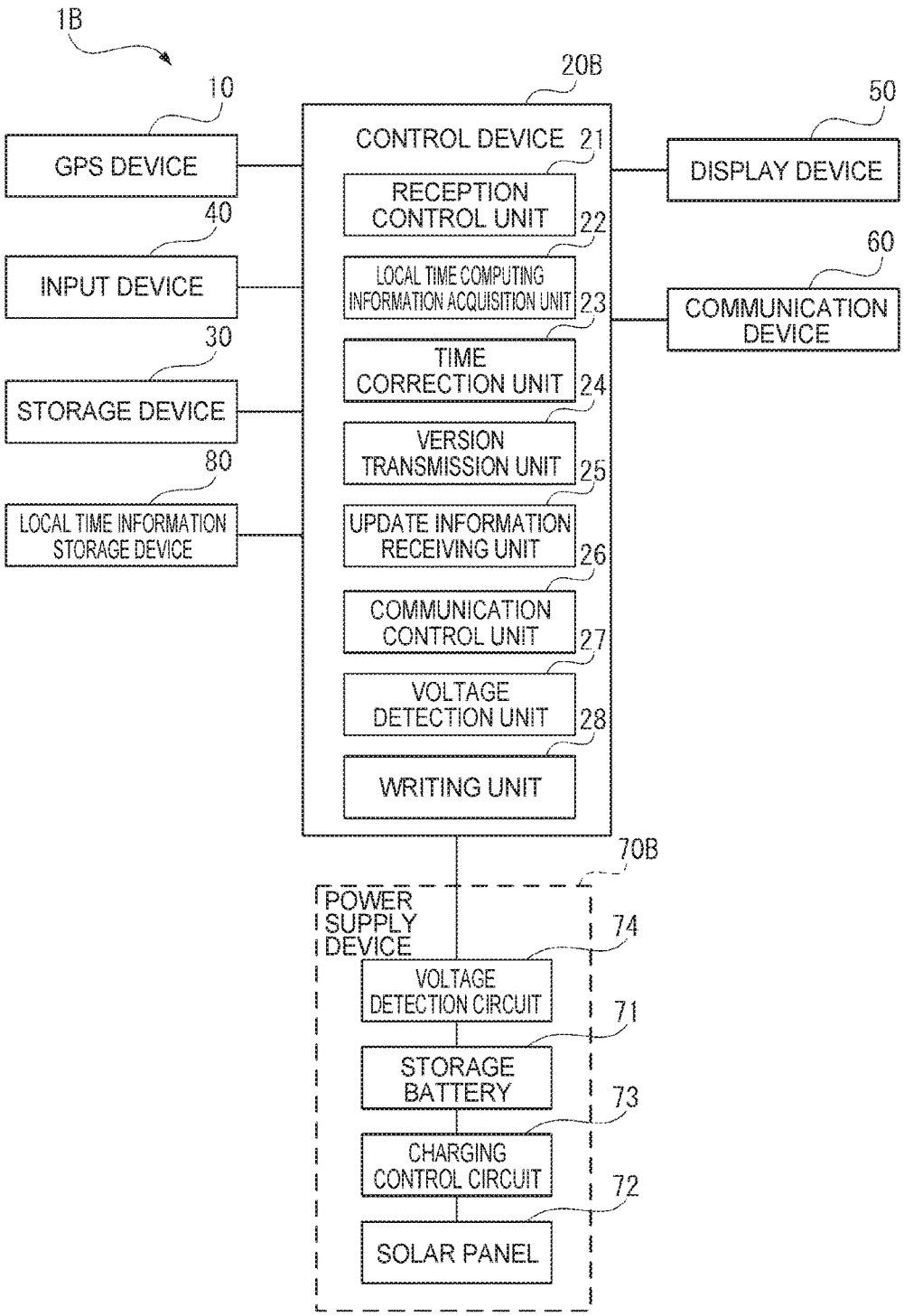
FIG. 16 is a block diagram illustrating the configuration of an electronic timepiece according to a third embodiment of the invention.

FIG. 16 is a block diagram illustrating the configuration of the electronic timepiece 1B according to the third embodiment of the invention.

As shown in FIG. 16, the electronic timepiece 1B has a GPS device 10, a control device 20B (CPU), a storage device 30, an input device 40, a display device 50, a communication device 60, a power supply device 70B, and a local time information storage device 80.

The power supply device 70B has a storage battery 71 as the power supply unit, a solar panel 72, a charging control circuit 73, and a voltage detection circuit 74. The power supply device 70B charges the storage battery 71 through the charging control circuit 73 with power produced by the solar panel 72.

The control device 20B includes a reception control unit 21, a local time computing information acquisition unit 22, a time correction unit 23, a version transmission unit 24, an update information receiving unit 25, a communication control unit 26, a voltage detection unit 27, and a writing unit 28 as a first rewriting unit.

The voltage detection unit 27 detects the voltage of the storage battery 71, that is, the power supply voltage, with the voltage detection circuit 74, and detects how much power can be charged to the storage battery 71. A reserve power detection unit that detects the reserve power in the storage battery 71 is thus embodied by the voltage detection unit 27.

If the voltage (reserve power) detected by the voltage detection unit 27 is greater than or equal to a specific threshold (first threshold), the writing unit 28 overwrites the local time information 83 with new local time information reflecting the update information 85. The writing unit 28 also overwrites the first version information 84 with the version of the new local time information.

The specific supply voltage threshold is set to a level that enables continuing driving the electronic timepiece 1B and will not result in the voltage of the storage battery 71 dropping and the system shutting down if the writing unit 28 runs the rewriting process.

Figure 17:
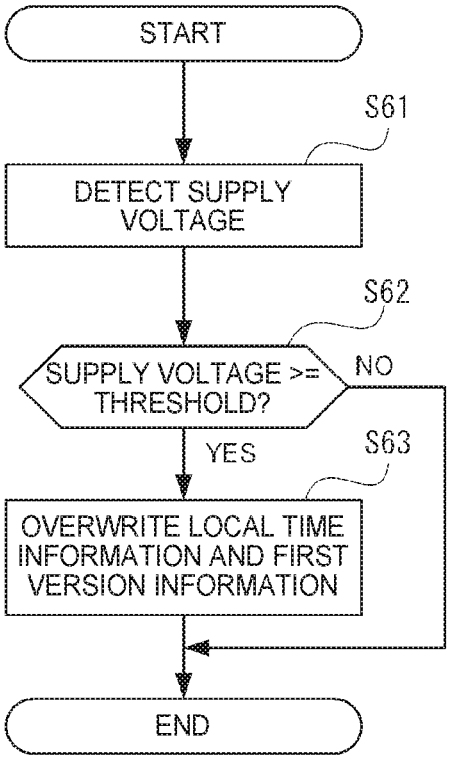
FIG. 17 is a flow chart of the rewriting process of an electronic timepiece according to the third embodiment of the invention.

FIG. 17 is a flow chart illustrating an example of the local time information 83 rewriting process in the electronic timepiece 1B according to the third embodiment of the invention.

The rewriting process shown in FIG. 17 is executed when, for example, the voltage of the storage battery 71 reduced by the update information 85 update process returns to or above the first threshold as a result of charging by the solar panel 72. Note that the timing of the rewriting process is not so limited, and the process may execute in response to a start command from the user, or at another specific preset timing, such as at a specific time or a specific interval.

When the rewriting process runs, the voltage detection unit 27 detects the supply voltage using the voltage detection circuit 74 as shown in FIG. 17 (step S61).

Next, if the supply voltage is greater than or equal to the threshold (step S62: YES), the writing unit 28 overwrites the local time information 83 stored in the first storage unit 81 with the update information 85 stored in the second storage unit 82. The writing unit 28 also uses the second version information 86 to overwrite the first version information 84 to match the version of the new local time information after being overwritten.

If the supply voltage is less than the threshold (step S62: NO), the writing unit 28 does not overwrite the local time information 83 and ends the process.

Effect of Embodiment 3

In addition to the effects of the first embodiment described above, this third embodiment has the following effect.

Because the rewriting process runs in this third embodiment if the voltage of the storage battery 71 is greater than or equal to a first threshold, and the rewriting process does not run if voltage is less than the threshold, the electronic timepiece 1B can continue to be driven stably even if storage battery 71 power is consumed by the rewriting process.

Embodiment 4

A fourth embodiment of the invention is described next with reference to FIG. 18 and FIG. 19.

When the most recent update information for the local time information is stored in the second storage unit, the electronic timepiece according to the fourth embodiment of the invention executes the rewriting process of overwriting the local time information stored in the first storage unit with the update information if the output voltage of the solar panel of the power supply device is greater than or equal to a specific threshold.

Note that like or similar parts in this and the foregoing embodiments are identified by the same reference numerals, and further description thereof is omitted or simplified.

Figure 18:
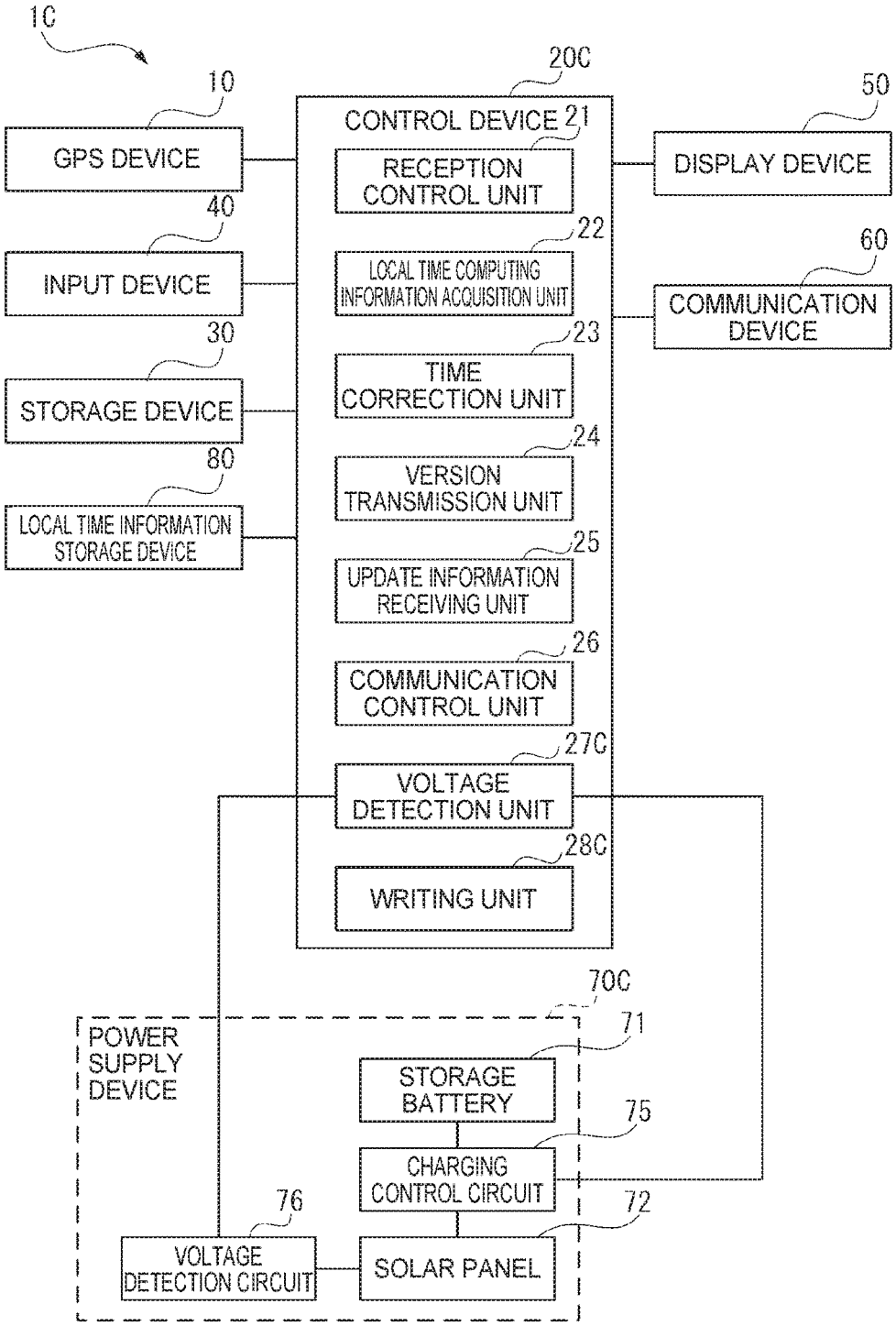
FIG. 18 is a block diagram illustrating the configuration of an electronic timepiece according to a fourth embodiment of the invention.

FIG. 18 is a block diagram illustrating the configuration of the electronic timepiece 1C according to the fourth embodiment of the invention.

As shown in FIG. 18, the electronic timepiece 1C has a GPS device 10, a control device 20C (CPU), a storage device 30, an input device 40, a display device 50, a communication device 60, a power supply device 70C, and a local time information storage device 80.

The power supply device 70C has a storage battery 71 that stores electrical energy, a solar panel 72 and a generating unit, a charging control circuit 75, and a voltage detection circuit 76 as a power detection unit. The power supply device 70C charges the storage battery 71 through the charging control circuit 75 with power produced by the solar panel 72.

The charging control circuit 75 can switch between a charging state in which the storage battery 71 and solar panel 72 are connected through the charging control circuit 75 and voltage detection circuit 76, and a non-charging state in which the storage battery 71 and solar panel 72 are not connected, as controlled by the control device 20C.

When the charging control circuit 75 is set to the non-charging state as controlled by the control device 20C, the voltage detection circuit 76 detects the open-circuit voltage of the solar panel 72 as the output voltage.

The control device 20C includes a reception control unit 21, a local time computing information acquisition unit 22, a time correction unit 23, a version transmission unit 24, an update information receiving unit 25, a communication control unit 26, a voltage detection unit 27C as a power detection unit, and a writing unit 28C as a second rewriting unit.

The voltage detection unit 27C detects the output voltage of the solar panel 72. As a result, the control device 20C detects the power per unit time (that is, the generating capacity) that the solar panel 72 can supply. The voltage detection unit 27C also functions as a switching means that controls the charging control circuit 75 to switch between the charging state and non-charging state.

When the generating capacity detected by the voltage detection unit 27C equals or exceeds a specific threshold (second threshold), the writing unit 28C overwrites the local time information 83 with the new local time information reflecting the update information 85.

The threshold value for the output voltage is set to a value corresponding to the output power that enables stably driving the electronic timepiece 1C regardless of the reserve capacity of the storage battery 71 if the electronic timepiece 1C runs the rewriting process.

Figure 19:
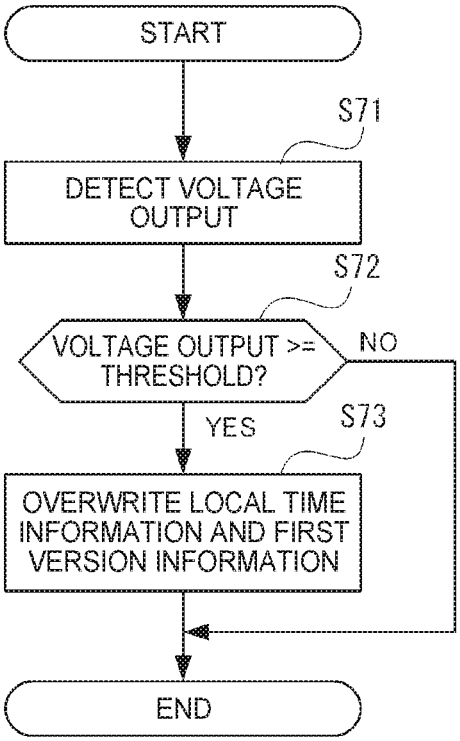
FIG. 19 is a flow chart of the rewriting process of an electronic timepiece according to the fourth embodiment of the invention.

FIG. 19 is a flow chart illustrating an example of the local time information 83 rewriting process in the electronic timepiece 1C according to the fourth embodiment of the invention.

The rewriting process shown in FIG. 19 may execute at the same timing as in the electronic timepiece 1B according to the third embodiment of the invention. When the rewriting process runs, the voltage detection unit 27C controls the charging control circuit 75 to switch from the charging state to the non-charging state, and uses the voltage detection circuit 76 to detect the output voltage as shown in FIG. 19 (step S71).

Next, if the output voltage is greater than or equal to the threshold (step S72: YES), the writing unit 28C overwrites the local time information 83 and the first version information 84 as in the electronic timepiece 1B of the third embodiment (step S73).

If the output voltage is less than the threshold (step S72: NO), the writing unit 28C ends the process without rewriting the local time information 83.

Effect of Embodiment 4

In addition to the effects of the first embodiment described above, this fourth embodiment has the following effect.

Because the rewriting process runs in this fourth embodiment if the power output of the solar panel 72 is greater than or equal to a specific threshold (second threshold), and the rewriting process does not run if voltage is less than the threshold, the electronic timepiece 1C can continue to be driven stably.

The voltage detection circuit 76 can detect the power output of the solar panel by a simple assembly because the open-circuit voltage of the solar panel 72 is detected as the power output when the charging control circuit 75 is set to the non-charging state by the control device 20C.

Variations

The invention is not limited to the embodiments described above, and can be modified and improved in many ways without departing from the scope of the accompanying claims.

Figure 20:
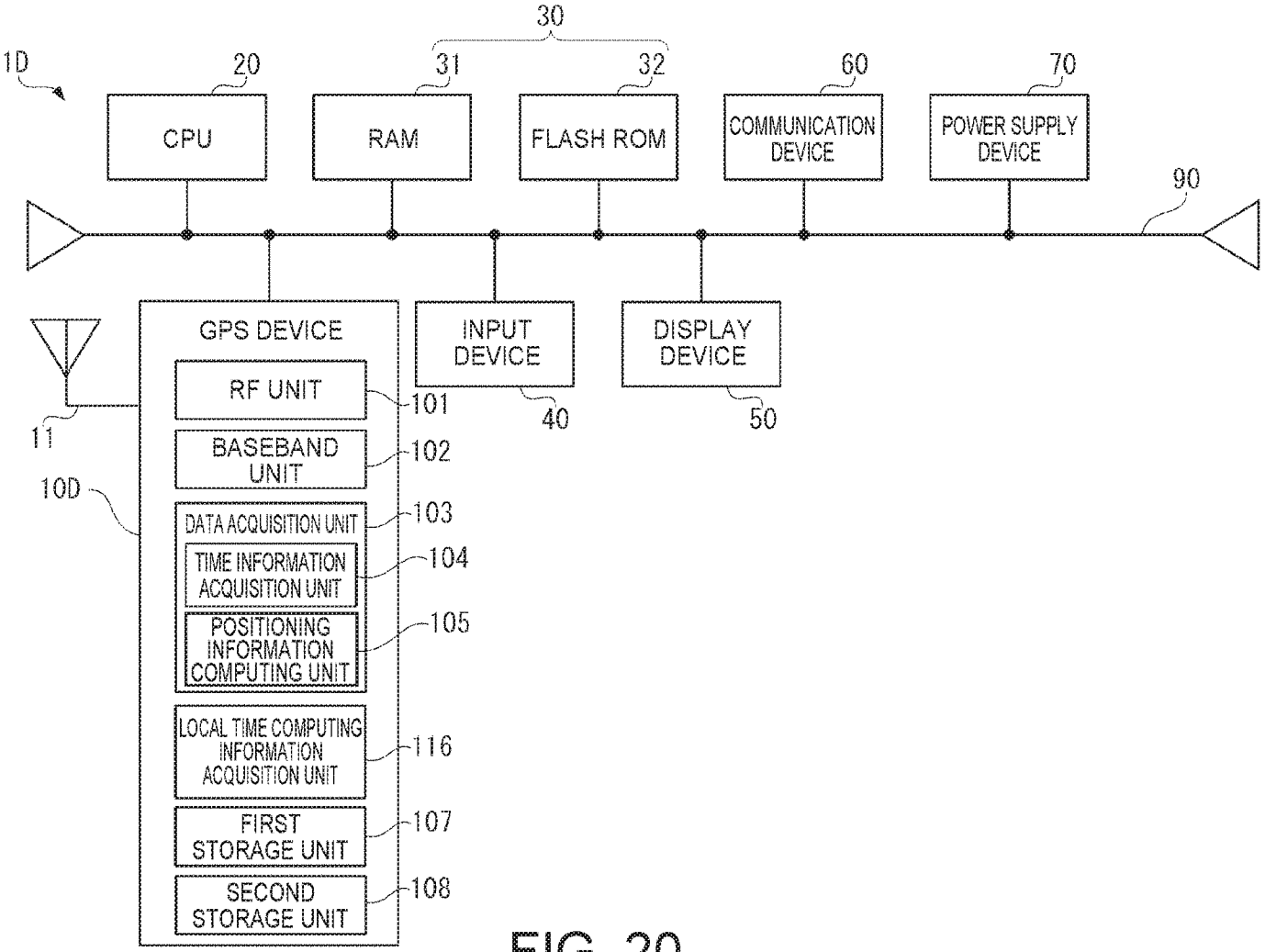
FIG. 20 is a block diagram illustrating the configuration of an electronic timepiece according to another embodiment of the invention.

For example, as shown in FIG. 20, the first storage unit 107 and second storage unit 108 may be disposed in the GPS device 10D. In the electronic timepiece 1D shown in FIG. 20, the GPS device 10D comprises the first storage unit 107, the second storage unit 108, and the local time computing information acquisition unit 116. This second storage unit 108 stores the update information 85 and second version information 86 similarly to the second storage unit 82 in the embodiments described above.

The local time computing information acquisition unit 116 also executes the same process as the local time computing information acquisition unit 22 in the first embodiment, and acquires the local time computing information.

Thus comprised, the electronic timepiece 1D can reduce the processing load of the control device 20 because the local time computing information is acquired by the GPS device 10D.

The electronic timepieces in the foregoing embodiments communicate with the electronic device 120 by wireless communication, but the invention is not so limited and the electronic timepiece may be configured to communicate by wired communication.

Note that to enable wired communication, a dedicated terminal for connecting to the signal cable used to communicate with the electronic device 120 may be provided in the outside case of the electronic timepiece.

Communication with the electronic device 120 may also be enabled through a terminal that is exposed to the outside when part of the electronic timepiece case is removed (such as the back cover on the opposite side as the dial), and a special tool that connects to this terminal.

The supply voltage of the storage battery 71 is detected in the third embodiment, but the invention is not so limited. The amount of power that the storage battery 71 can supply may also be detected by detecting the storage battery 71 current.

The power output of the solar panel 72 in a non-charging state is detected in the fourth embodiment, but the invention is not so limited. For example, the output voltage of the solar panel 72 in the charging state may be detected, or the power output may be detected by detecting the current of the charging control circuit.

The data acquisition unit 103 is contained in the GPS device 10 in the foregoing embodiments, but the control device 20 may be configured to execute the function of the data acquisition unit 103. In this case, the satellite signal receiver unit is configured with the GPS device 10 and the control device 20.

The update information database 131 is stored on the server 130 in the foregoing embodiments, but the update information database may be stored in the electronic device 120. In this case, the electronic device 120 can determine if there is update information to send, and can transmit the most recent update information, based on the version information. Functions identical to those of the electronic device 120 and server 130 in the foregoing embodiments may also be embodied by one or three or more devices.

The foregoing embodiments describe a timepiece with hands 3, but the invention can obviously be used in a digital timepiece that does not have hands. The invention is also not limited to a wristwatch, and can be widely used in a variety of mobile electronic timepieces, including pocket watches.

The invention can also be used in a wide range of electronic devices, including mobile phones with a satellite signal reception ability and timekeeping function, and navigation devices. The local time information can also be updated when the invention is used in such electronic devices.

The foregoing embodiments are described with reference to a GPS satellite as an example of a positioning information satellite, but the invention can also be used with other types of positioning information satellites, including Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The invention can also be used in electronic timepieces and electronic devices that have both a reception unit for receiving satellite signals from positioning information satellites, and a reception unit for receiving standard time signals. The invention can also be used in electronic timepieces and electronic devices that do not have a reception unit for receiving satellite signals or standard time signals, but are configured to enable manually setting the positioning information or time information.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2015-17215, filed Jan. 30, 2015 is expressly incorporated by reference herein.

What is claimed is:

1. An electronic timepiece comprising:

a time display unit that displays a time;

a satellite signal receiver that receives satellite signals transmitted from positioning information satellites and computes positioning information based on the satellite signals;

a first storage unit that stores the positioning information and local time information, the local time information including local time computing information related to a time in a region identified by the positioning information, wherein the local time computing information further includes at least one of (i) time zone information associated with the identified region and (ii) daylight savings time information associated with the identified region;

an update information receiving unit that receives update information from an update information transmission device, wherein the update information corresponds to an update of the local time computing information including the at least one of the time zone information and the daylight savings time information;

a second storage unit that stores the update information received by the update information receiving unit;

a local time computing information acquisition unit that acquires the local time computing information from the first storage unit in response to the local time computing information corresponding to the positioning information calculated by the satellite signal receiver being stored only in the first storage unit, and acquires the local time computing information from the second storage unit in response to the update of the local time computing information being stored in the second storage unit; and a time correction unit that corrects the time displayed by the time display unit based on the local time computing information.

2. The electronic timepiece described in claim 1, wherein:

the local time computing information acquisition unit references the second storage unit, acquires the local time computing information corresponding to the positioning information based on the update information if the local time computing information corresponding to the positioning information is included in the update information stored in the second storage unit, and if the local time computing information corresponding to the positioning information is not included in the update information stored in the second storage unit, references the first storage unit and acquires local time computing information corresponding to the positioning information based on the local time information stored in the first storage unit.

3. The electronic timepiece described in claim 1, wherein:

the update information is difference data expressing the difference with the local time information stored in the first storage unit.

4. The electronic timepiece described in claim 1, further comprising:

a communication unit that communicates wirelessly with the update information transmission device;

the update information receiving unit acquiring the update information transmitted from the update information transmission device through the communication unit.

5. An electronic timepiece, comprising:

a time display unit that displays a time;

a satellite signal receiver that receives satellite signals transmitted from positioning information satellites and computes positioning information based on the satellite signals;

a first storage unit that stores the positioning information and local time information including local time computing information related to a time in a region identified by the positioning information;

an update information receiving unit that receives update information from an update information transmission device that transmits update information, which is updated local time information;

a second storage unit that stores the update information received by the update information receiving unit;

a local time computing information acquisition unit that acquires the local time computing information from the first storage unit when the local time computing information corresponding to the positioning information calculated by the satellite signal receiver is stored only in the first storage unit, and acquires the local time computing information from the second storage unit when the local time computing information is stored in the second storage unit; and a time correction unit that corrects the time displayed by the time display unit based on the local time computing information, wherein first version information indicating the version of the local time information stored in the first storage unit is stored in the first storage unit; and a first transmission unit reads and sends the first version information from the first storage unit to the update information transmission device.

6. An electronic timepiece, comprising:

a time display unit that displays a time;

a satellite signal receiver that receives satellite signals transmitted from positioning information satellites and computes positioning information based on the satellite signals;

a first storage unit that stores the positioning information and local time information including local time computing information related to a time in a region identified by the positioning information;

an update information receiving unit that receives update information from an update information transmission device that transmits update information, which is updated local time information;

a second storage unit that stores the update information received by the update information receiving unit;

a local time computing information acquisition unit that acquires the local time computing information from the first storage unit when the local time computing information corresponding to the positioning information calculated by the satellite signal receiver is stored only in the first storage unit, and acquires the local time computing information from the second storage unit when the local time computing information is stored in the second storage unit; and a time correction unit that corrects the time displayed by the time display unit based on the local time computing information, wherein:

second version information indicating the version of the update information stored in the second storage unit is stored in the second storage unit; and a second transmission unit reads and sends the second version information from the second storage unit to the update information transmission device.

7. An electronic timepiece, comprising:

a time display unit that displays a time;

a satellite signal receiver that receives satellite signals transmitted from positioning information satellites and computes positioning information based on the satellite signals;

a first storage unit that stores the positioning information and local time information including local time computing information related to a time in a region identified by the positioning information;

an update information receiving unit that receives update information from an update information transmission device that transmits update information, which is updated local time information;

a second storage unit that stores the update information received by the update information receiving unit;

a local time computing information acquisition unit that acquires the local time computing information from the first storage unit when the local time computing information corresponding to the positioning information calculated by the satellite signal receiver is stored only in the first storage unit, and acquires the local time computing information from the second storage unit when the local time computing information is stored in the second storage unit;

a time correction unit that corrects the time displayed by the time display unit based on the local time computing information;

a storage battery;

a reserve power detection unit that detects the reserve power of the storage battery; and a first writing unit that overwrites data corresponding to the update information in the local time information stored in the first storage unit with the update information stored in the second storage unit if the reserve power detected by the reserve power detection unit is greater than or equal to a first threshold.

8. An electronic timepiece, comprising:

a time display unit that displays a time;

a satellite signal receiver that receives satellite signals transmitted from positioning information satellites and computes positioning information based on the satellite signals;

a first storage unit that stores the positioning information and local time information including local time computing information related to a time in a region identified by the positioning information;

an update information receiving unit that receives update information from an update information transmission device that transmits update information, which is updated local time information;

a second storage unit that stores the update information received by the update information receiving unit;

a local time computing information acquisition unit that acquires the local time computing information from the first storage unit when the local time computing information corresponding to the positioning information calculated by the satellite signal receiver is stored only in the first storage unit, and acquires the local time computing information from the second storage unit when the local time computing information is stored in the second storage unit;

a time correction unit that corrects the time displayed by the time display unit based on the local time computing information;

a generating unit;

a storage battery that stores electrical energy produced by the generating unit;

a power detection unit that detects the output power of the generating unit; and a second writing unit that overwrites data corresponding to the update information in the local time information stored in the first storage unit with the update information stored in the second storage unit if the power output detected by the power detection unit is greater than or equal to a second threshold.

9. An electronic timepiece, comprising:

a time display unit that displays a time;

a satellite signal receiver that receives satellite signals transmitted from positioning information satellites and computes positioning information based on the satellite signals;

a first storage unit that stores the positioning information and local time information including local time computing information related to a time in a region identified by the positioning information;

an update information receiving unit that receives update information from an update information transmission device that transmits update information, which is updated local time information;

a second storage unit that stores the update information received by the update information receiving unit;

a local time computing information acquisition unit that acquires the local time computing information from the first storage unit when the local time computing information corresponding to the positioning information calculated by the satellite signal receiver is stored only in the first storage unit, and acquires the local time computing information from the second storage unit when the local time computing information is stored in the second storage unit;

a time correction unit that corrects the time displayed by the time display unit based on the local time computing information; and an update information transmission device that sends update information to the electronic timepiece, the update information transmission device comprising:

a version acquisition unit that acquires first version information indicating the version of the local time information stored in the first storage unit from the electronic timepiece;

a data acquisition unit that, based on the first version information acquired by the version acquisition unit, acquires update information from an update information database storing update information; and a transmission process unit that transmits the update information acquired by the data acquisition unit to the electronic timepiece.

10. An electronic timepiece, comprising:

a time display unit that displays a time;

a satellite signal receiver that receives satellite signals transmitted from positioning information satellites and computes positioning information based on the satellite signals;

a first storage unit that stores the positioning information and local time information including local time computing information related to a time in a region identified by the positioning information;

an update information receiving unit that receives update information from an update information transmission device that transmits update information, which is updated local time information;

a second storage unit that stores the update information received by the update information receiving unit;

a local time computing information acquisition unit that acquires the local time computing information from the first storage unit when the local time computing information corresponding to the positioning information calculated by the satellite signal receiver is stored only in the first storage unit, and acquires the local time computing information from the second storage unit when the local time computing information is stored in the second storage unit;

a time correction unit that corrects the time displayed by the time display unit based on the local time computing information; and an update information transmission device that sends update information to the electronic timepiece, the update information transmission device comprising:

a version acquisition unit that acquires first version information indicating the version of the local time information stored in the first storage unit, and second version information indicating the version of the update information stored in the second storage unit, from the electronic timepiece;

a data acquisition unit that, based on at least one of the first version information and the second version information acquired by the version acquisition unit, acquires update information from an update information database storing update information; and a transmission process unit that transmits the update information acquired by the data acquisition unit to the electronic timepiece, and sends a terminal update process command to the electronic timepiece if transmitting the update information is determined unnecessary based on the second version information acquired by the version acquisition unit.

* * * * *